US007960309B2

(12) United States Patent
Irita et al.

(10) Patent No.: US 7,960,309 B2
(45) **Date of Patent: *Jun. 14, 2011**

(54) HEAT-SENSITIVE TRANSFER IMAGE-RECEIVING SHEET AND METHOD OF FORMING IMAGE

(75) Inventors: Kiyoshi Irita, Minami-ashigara (JP); Yoshihisa Tsukada, Minami-ashigara (JP)

(73) Assignee: FUJIFILM Corporation, Tokyo (JP)

( * ) Notice: Subject to any disclaimer, the term of this patent is extended or adjusted under 35 U.S.C. 154(b) by 991 days.

This patent is subject to a terminal disclaimer.

(21) Appl. No.: 11/715,865

(22) Filed: Mar. 9, 2007

(65) Prior Publication Data

US 2007/0213219 A1 Sep. 13, 2007

(30) Foreign Application Priority Data

Mar. 10, 2006 (JP) ..... 2006-065329

(51) Int. Cl.
*B41M 5/035* (2006.01)
*B41M 5/50* (2006.01)

(52) U.S. Cl. ..... 503/227; 428/32.39

(58) Field of Classification Search ..... None
See application file for complete search history.

(56) References Cited

U.S. PATENT DOCUMENTS 7,485,402 B2 * 2/2009 Arai et al. ..... 430/201

FOREIGN PATENT DOCUMENTS

| | | | |
|---|---|---|---|
| JP | 60-212394 | A | 10/1985 |
| JP | 63-312188 | A | 12/1988 |
| JP | 02-059396 | A | 2/1990 |
| JP | 2-265789 | A | 10/1990 |
| JP | 3-193392 | A | 8/1991 |
| JP | 4-107547 | A | 4/1992 |
| JP | 4-107548 | A | 4/1992 |
| JP | 4-197786 | A | 7/1992 |
| JP | 06-024151 | A | 2/1994 |
| JP | 07-017149 | A | 1/1995 |
| JP | 2572769 | | 10/1996 |
| JP | 2854319 | | 11/1998 |
| JP | 11-321139 | | 11/1999 |
| JP | 2005-238748 | | 9/2005 |

* cited by examiner

*Primary Examiner* — Bruce H Hess
(74) *Attorney, Agent, or Firm* — Sughrue Mion, PLLC

(57) ABSTRACT

A heat-sensitive transfer image-receiving sheet having at least one receptor layer containing a latex polymer which has a glass transition temperature of 50° C. or less, a latex polymer which has a glass transition temperature more than 50° C., and a wax dispersion, wherein at least one of the latex polymers is present in a particulate state without forming film; and a method of forming an image using the same.

13 Claims, No Drawings

HEAT-SENSITIVE TRANSFER IMAGE-RECEIVING SHEET AND METHOD OF FORMING IMAGE

FIELD OF THE INVENTION

The present invention relates to a heat-sensitive transfer image-receiving sheet and a method of forming an image through the use of the sheet. In particular, the present invention relates to a heat-sensitive transfer image-receiving sheet for providing a high-quality image of high densities and reduced image defects, in high-speed processing, and a method of forming an image through the use of the sheet.

BACKGROUND OF THE INVENTION

Various heat transfer recording methods have been known so far. Among these methods, dye diffusion transfer recording systems attract attention as a process that can produce a color hard copy having an image quality closest to that of silver salt photography (see, for example, "Joho Kiroku (Hard Copy) to Sono Zairyo no Shintenkai (Information Recording (Hard Copy) and New Development of Recording Materials)" published by Toray Research Center Inc., 1993, pp. 241-285; and "Printer Zairyo no Kaihatsu (Development of Printer Materials)" published by CMC Publishing Co., Ltd., 1995, p. 180). In this dye diffusion transfer recording system, a heat-sensitive transfer sheet (hereinafter also referred to as an ink sheet) containing dyes is superposed on a heat-sensitive transfer image-receiving sheet (hereinafter also referred to as an image-receiving sheet), and then the ink sheet is heated by a thermal head whose exothermic action is controlled by electric signals, in order to transfer the dyes contained in the ink sheet to the image-receiving sheet, thereby recording an image information. Three colors: cyan, magenta, and yellow, are used for recording a color image by overlapping one color to other, thereby enabling transferring and recording a color image having continuous gradation for color densities. Thus the images obtained are outstanding for reproducibility of halftones and gradation expression, and exceptionally high-definition images can be delivered.

Moreover, the dye diffusion transfer recording system has advantages that it is a dry process, it permits direct visualization from digital data, and it allows simple reproduction; and its market as a full-color hard copy system has been expanding.

As such a dye diffusion transfer recording system has become popular, improvements of printing speed have been progressing; and it has become apparent that sufficient color generation densities are no longer obtained by use of traditional ink sheets and image-receiving sheets and application of thermal energies utilized hitherto to those sheets. Therefore, improvements have been made by a method of applying greater thermal energy than ever at the time of printing, and a method of enhancing thermal conduction efficiency by reducing the thickness of the support of ink sheet. These actions for increasing thermal energy to be applied to an image-receiving sheet at the time of printing, necessitates an image-receiving sheet that can ensure to perform both responsiveness to low thermal energy in low-density portions and responsiveness to high thermal energy in high-density portions. In general, a thermoplastic polymer is used as a receptor polymer of an image-receiving sheet, and the compatibility between transferring property of dyes (generally, the lower Tg the thermoplastic resin has, the higher transferring property of dyes the resin has) and releasing property from ink sheet (the higher Tg the thermoplastic resin has, the less the resin causes sticking due to welding) is ensured by controlling the glass transition temperature (Tg) of the thermoplastic polymer. Therefore, it is difficult to achieve both transferring property of dyes and releasing property from ink sheet at the same time over a wide range of temperatures.

Further, a method of providing a protective layer on an image surface by lamination, for the purpose of protecting the image surface and enhancing image fastness, has become the mainstream of the recent dye diffusion transfer recording system. Therefore, it is required to give attention to transferring property of protective layer to a heat-sensitive transfer image-receiving sheet. In general, the temperature at the time of transferring a protective layer is adjusted to a temperature lower than dye transfer temperatures (at least lower than the temperature to achieve the maximum density), for the purpose of avoiding thermal diffusion of the image. Thus, an image-receiving sheet which has good releasing property from ink sheet tends to have difficulty in transferring thereon a protective layer from the ink sheet.

In order to solve these problems, methods of introducing a releasing agent to the image-receiving sheet surface have been proposed. For instance, Japanese Patent Nos. 2572769 and 2854319 describe addition of a releasing agent, such as polyethylene wax, amide wax, or Teflon (trademark) powder, to a receptor layer of a heat-sensitive transfer image-receiving sheet, and disclose inventions which improve releasing property from ink sheet. However, these patents are silent on a method for ensuring compatibilities with transferring property of dyes and transferring property of protective layer.

JP-A-11-321139 ("JP-A" means unexamined published Japanese patent application) discloses a method of introducing carnauba wax to a receptor layer made up of a certain polyester compound. Therein, it is described that the method can prevent sticking effectively and can improve the releasing property from ink sheet.

JP-A-2005-238748 discloses the method of enhancing releasing property from ink sheet while heightening the transfer densities, by introduction of urethane-modified wax to the image-receiving sheet. However, this reference is also silent on a method for ensuring the compatibility with transferring property of protective layer.

The image-receiving sheets disclosed in these patent documents established certain levels of compatibilities with transferring property of dyes and releasing property from ink sheet, and further with transferring property of protective layer which was achieved by addition amount adjustment. However, they have not reached sufficient levels yet, so they are not satisfactory. Further, any methods for positively enhance the transferring property of protective layer are not suggested in these published patents.

SUMMARY OF THE INVENTION

The present invention resides in a heat-sensitive transfer image-receiving sheet having at least one receptor layer containing a latex polymer which has a glass transition temperature of 50° C. or less, a latex polymer which has a glass transition temperature more than 50° C., and a wax dispersion, wherein at least one of the latex polymers is present in a particulate state without forming film.

Further, the present invention resides in a method of forming an image, which uses the above heat-sensitive transfer image-receiving sheet and a heat-sensitive transfer sheet having a dye on a support, wherein the method comprises the steps of bringing these sheets into face-to-face contact with each other and applying heat thereto, to form a heat-transferred dye image.

Other and further features and advantages of the invention will appear more fully from the following description.

DETAILED DESCRIPTION OF THE INVENTION

The present invention provides the following means.

(1) A heat-sensitive transfer image-receiving sheet, comprising at least one receptor layer containing a latex polymer which has a glass transition temperature of 50° C. or less, a latex polymer which has a glass transition temperature more than 50° C., and a wax dispersion, wherein at least one of the latex polymers is present in a particulate state without forming film.

(2) The heat-sensitive transfer image-receiving sheet as described in (1), wherein at least one of the latex polymers contains repeating units of vinyl chloride component.

(3) The heat-sensitive transfer image-receiving sheet as described in (1) or (2), which further contains a water-soluble polymer in addition to the latex polymer.

(4) The heat-sensitive transfer image-receiving sheet as described in (3), which further contains a compound capable of cross-linking molecules of the water-soluble polymer and thereby at least a part of the water-soluble polymer molecules are cross-linked.

(5) The heat-sensitive transfer image-receiving sheet as described in any of (1) to (4), which further has at least one heat insulation layer, wherein the heat insulation layer has a void structure or contains hollow polymer particles.

(6) The heat-sensitive transfer image-receiving sheet as described in (5), wherein the heat insulation layer contains hollow polymer particles.

(7) A method of forming an image, which uses the heat-sensitive transfer image-receiving sheet as described in any one of (1) to (6) and a heat-sensitive transfer sheet having a dye on a support, wherein the method comprises the steps of bringing these sheets into face-to-face contact with each other and applying heat thereto, to form a heat-transferred dye image.

The present invention provides a heat-sensitive transfer image-receiving sheet, which gives high transfer densities in a high-speed transfer processing, which is reduced in image defects resulting from sticking due to welding (thermal fusion) with an ink, which is reduced in defects at the time of transmit through a printer, which is free of uneven transfer of a protective layer, and which gives a high quality image; and further the present invention provides a method of forming an image through the use of such an image-receiving sheet.

The present invention is described below in detail.

The heat-sensitive transfer image-receiving sheet of the present invention has, on a support, at least one dye-receptor layer (receptor layer). Further, the present image-receiving sheet may have at least one heat insulation layer (porous layer) between the support and the receptor layer. In addition, undercoat layers, such as a white-background adjustment layer, an electrification control layer, an adhesive layer, and a primer layer, may be formed between the receptor layer and the heat insulation layer.

The receptor layer and the heat insulation layer are preferably formed by a simultaneous multi-layer coating. When the undercoat layer is provided, the receptor layer, the undercoat layer, and the heat insulation layer may be formed by the simultaneous multi-layer coating.

It is preferable that a curling control layer, a writing layer, and a charge-control layer be formed on the back side of the support. Each layer on the back side of the support is applied using a usual method such as a roll coating, a bar coating, a gravure coating, and a gravure reverse coating.

(Receptor Layer)

The receptor layer plays the rolls of receptor of dyes transferred from an ink sheet and retainer of the image formed. In the image-receiving sheet of the present invention, the receptor layer contains a latex polymer, and further contains a wax dispersion. One feature of the present invention is that at least one latex polymer is present in a particulate state without forming film.

In addition, the receptor layer preferably contains a water-soluble polymer as described later. Moreover, it is preferable that the receptor layer contain a compound capable of cross-linking the water-soluble polymer molecules and thereby at least a part of the water-soluble polymer molecules are cross-linked.

Herein, the receptor layer may be a single layer or a multiple layer formed of two or more layers.

<Latex Polymer>

The latex polymer that can be used in the present invention will be explained.

In the heat-sensitive transfer image-receiving sheet of the present invention, latex polymers that can be used in the receptor layer contains at least one latex polymer which has a glass transition temperature of 50° C. or less and at least one latex polymer which has a glass transition temperature more than 50° C., and besides, at least one of the latex polymers is present in a particulate state without forming polymer film (preferably, as a dispersion of fine particles of water-insoluble thermoplastic resin (polymer) in a water-soluble dispersion medium). Further, the latex is preferably a dispersion obtained by dispersing fine particles of a hydrophobic polymer containing vinyl chloride as a monomer unit (i.e. containing repeating units of vinyl chloride component) in a water-soluble dispersion medium. The dispersed state may be one in which polymer is emulsified in a dispersion medium, one in which polymer underwent emulsion polymerization, one in which polymer underwent micelle dispersion, one in which polymer molecules partially have a hydrophilic structure and thus the molecular chains themselves are dispersed in a molecular state, or the like. Latex polymers are described in "Gosei Jushi Emulsion (Synthetic Resin Emulsion)", compiled by Taira Okuda and Hiroshi Inagaki, issued by Kobunshi Kanko Kai (1978); "Gosei Latex no Oyo (Application of Synthetic Latex)", compiled by Takaaki Sugimura, Yasuo Kataoka, Souichi Suzuki, and Keishi Kasahara, issued by Kobunshi Kanko Kai (1993); Soichi Muroi, "Gosei Latex no Kagaku (Chemistry of Synthetic Latex)", issued by Kobunshi Kanko Kai (1970); Yoshiaki Miyosawa (supervisor) "Suisei Coating-Zairyo no Kaihatsu to Oyo (Development and Application of Aqueous Coating Material)", issued by CMC Publishing Co., Ltd. (2004) and JP-A-64-538, and so forth. The dispersed particles preferably have a mean particle size (diameter) of about 1 to 50,000 nm, more preferably about 5 to 1,000 nm.

The particle diameter distribution of dispersed particles has no particular limitation, and the dispersed particles may have either a broad particle-diameter distribution or a monodisperse particle-diameter distribution.

As the polymer latex of the present invention, a polymer latex in which the polymer has a glass transition temperature of 50° C. or less and a polymer latex in which the polymer has a glass transition temperature more than 50° C. are used in combination. The glass transition temperature of the latex polymer lower in glass transition temperature is preferably from −30° C. to 50° C., more preferably from 0° C. to 45° C., further preferably from 10° C. to 45° C., and particularly preferably from 15° C. to 45° C. The glass transition temperature of the latex polymer higher in glass transition temperature is preferably from more than 50° C. to 120° C., more preferably from more than 50° C. to 100° C., and further preferably from 60° C. to 80° C.

The glass transition temperature (Tg) is calculated according to the following equation:

$$1/Tg=\Sigma(Xi/Tgi)$$

wherein, assuming that the polymer is a copolymer composed of n monomers from i=1 to i=n, Xi is a weight fraction of the i-th monomer (ΣXi=1) and Tgi is glass transition temperature (measured in absolute temperature) of a homopolymer formed from the i-th monomer. The symbol Σ means the sum of i=1 to i=n. The value of the glass transition temperature of a homopolymer formed from each monomer (Tgi) is adopted from J. Brandrup and E. H. Immergut, "Polymer Handbook, 3rd. Edition", Wiley-Interscience (1989).

In the receptor layer according to the present invention, the latex of a thermoplastic resin constitutes preferably at least 50 mass %, more preferably at least 60 mass %, further preferably at least 70 mass %, of the total solid content in the layer.

In addition, the proportion of the latex polymer whose Tg is 50° C. or less to the latex polymer whose Tg is more than 50° C. in the latexes of thermoplastic polymers should be adjusted from the viewpoints of transferring property of dyes, releasing property of image-receiving sheet from ink sheet, and transferring property of protective layer; and the proportion of the latex polymer whose Tg is 50° C. or less is preferably from 2 mass % to 70 mass %, more preferably from 5 mass % to 60 mass %, further preferably from 8 mass % to 40 mass % of the latex polymer whose Tg is more than 50° C.

Further, this proportion is preferably adjusted in combination with the addition amount of wax which will be described later.

In the present invention, as preferable types of latex polymer, hydrophobic polymers such as acrylic-series polymers, polyesters, rubbers (e.g., SBR resins), polyurethanes, polyvinyl chlorides, polyvinyl acetates, polyvinylidene chlorides, and polyolefins, are preferably used. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The molecular weight of each of these polymers is preferably 5,000 to 1,000,000, and further preferably 10,000 to 500,000 in terms of number average molecular weight. Polymers having excessively small molecular weight impart insufficient dynamic strength to a layer containing the latex, and polymers having excessively large molecular weight bring about poor filming ability, and therefore both cases are undesirable. Crosslinkable latex polymers are also preferably used.

No particular limitation is imposed on the monomer to be used in synthesizing the latex polymer that can be used in the present invention, and the following monomer groups (a) to (j) may be preferably used as those polymerizable in a usual radical polymerization or ion polymerization method. These monomers may be selected singly or combined freely to synthesize a latex polymer.

-Monomer Groups (a) to (j)-

(a) Conjugated dienes: 1,3-pentadiene, isoprene, 1-phenyl-1,3-butadiene, 1-α-naphthyl-1,3-butadiene, 1-β-naphthyl-1,3-butadiene, cyclopentadiene, etc.

(b) Olefins: ethylene, propylene, vinyl chloride, vinylidene chloride, 6-hydroxy-1-hexene, 4-pentenoic acid, methyl 8-nonenate, vinylsulfonic acid, trimethylvinylsilane, trimethoxyvinylsilane, 1,4-divinylcyclohexane, 1,2,5-trivinylcyclohexane, etc.

(c) α,β-unsaturated carboxylates: alkyl acrylates, such as methyl acrylate, ethyl acrylate, butyl acrylate, cyclohexyl acrylate, 2-ethylhexyl acrylate, and dodecyl acrylate; substituted alkyl acrylates, such as 2-chloroethyl acrylate, benzyl acrylate, and 2-cyanoethyl acrylate; alkyl methacrylates, such as methyl methacrylate, butyl methacrylate, 2-ethylhexyl methacrylate, and dodecyl methacrylate; substituted alkyl methacrylates, such as 2-hydroxyethyl methacrylate, glycidyl methacrylate, glycerin monomethacrylate, 2-acetoxyethyl methacrylate, tetrahydrofurfuryl methacrylate, 2-methoxyethyl methacrylate, polypropylene glycol monomethacrylates (mole number of added polyoxypropylene=2 to 100), 3-N,N-dimethylaminopropyl methacrylate, chloro-3-N,N,N-trimethylammoniopropyl methacrylate, 2-carboxyethyl methacrylate, 3-sulfopropyl methacrylate, 4-oxysulfobutyl methacrylate, 3-trimethoxysilylpropyl methacrylate, allyl methacrylate, and 2-isocyanatoethyl methacrylate; derivatives of unsaturated dicarboxylic acids, such as monobutyl maleate, dimethyl maleate, monomethyl itaconate, and dibutyl itaconate; multifunctional esters, such as ethylene glycol diacrylate, ethylene glycol dimethacrylate, 1,4-cyclohexane diacrylate, pentaerythritol tetramethacrylate, pentaerythritol triacrylate, trimethylolpropane triacrylate, trimethylolethane triacrylate, dipentaerythritol pentamethacrylate, pentaerythritol hexaacrylate, and 1,2,4-cyclohexane tetramethacrylate; etc.

(d) α,β-unsaturated carboxylic amides: acrylamide, methacrylamide, N-methylacrylamide, N,N-dimethylacrylamide, N-methyl-N-hydroxyethylmethacrylamide, N-tert-butylacrylamide, N-tert-octylmethacrylamide, N-cyclohexylacrylamide, N-phenylacrylamide, N-(2-acetoacetoxyethyl)acrylamide, N-acryloylmorpholine, diacetone acrylamide, itaconic diamide, N-methylmaleimide, 2-acrylamide-methylpropane sulfonic acid, methylenebisacrylamide, dimethacryloylpiperazine, etc.

(e) Unsaturated nitriles: acrylonitrile, methacrylonitrile, etc.

(f) Styrene and derivatives thereof: styrene, vinyltoluene, p-tert-butylstyrene, vinylbenzoic acid, methyl vinylbenzoate, α-methylstyrene, p-chloromethylstyrene, vinylnaphthalene, p-hydroxymethylstyrene, sodium p-styrenesulfonate, potassium p-styrenesulfinate, p-aminomethylstyrene, 1,4-divinylbenzene, etc.

(g) Vinyl ethers: methyl vinyl ether, butyl vinyl ether, methoxyethyl vinyl ether, etc.

(h) Vinyl esters: vinyl acetate, vinyl propionate, vinyl benzoate, vinyl salicylate, vinyl chloroacetate, etc.

(i) α,β-unsaturated carboxylic acids and salts thereof: acrylic acid, methacrylic acid, itaconic acid, maleic acid, sodium acrylate, ammonium methacrylate, potassium itaconate, etc.

(j) Other polymerizable monomers: N-vinylimidazole, 4-vinylpyridine, N-vinylpyrrolidone, 2-vinyloxazoline, 2-isopropenyloxazoline, divinylsulfone, etc.

Among the above, preferred are copolymers between vinyl chloride and any monomer selected from α,β-unsaturated carboxylates, vinyl esters, and ethylene; more preferred are copolymers between vinyl chloride and any monomer selected from α,β-unsaturated carboxylates and vinyl esters; particularly preferred are copolymers between vinyl chloride and any monomer selected from α,β-unsaturated carboxylates).

Latex polymer that can be used in the present invention is also commercially available, and the following polymers can also be used.

Examples of the acrylic-series polymers include Cevian A4635, 4718, and 4601 (trade names, manufactured by Daicel Chemical Industries); Nipol Lx81, 814, 821, 820, 855 (P-17: Tg 36° C.), and 857×2 (P-18: Tg 43° C.) (trade names, manufactured by Nippon Zeon Co., Ltd.); Voncoat R3370 (P-19: Tg 25° C.), and 4280 (P-20: Tg 15° C.) (trade names, manufactured by Dai-Nippon Ink & Chemicals, Inc.); Julimer ET-410 (P-21: Tg 44° C.) (trade name, manufactured by Nihon Junyaku K.K.); AE116 (P-22: Tg 50° C.), AE119 (P-23: Tg 55° C.), AE121 (P-24: Tg 58° C.), AE125 (P-25: Tg 60° C.), AE134 (P-26: Tg 48° C.), AE137 (P-27: Tg 48° C.), AE140 (P-28: Tg 53° C.), and AE173 (P-29: Tg 60° C.) (trade names, manufactured by JSR Corporation); Aron A-104 (P-30: Tg 45° C.) (trade name, manufactured by Toagosei Co., Ltd.); NS-600X, and NS-620X (trade names, manufactured by Takamatsu Yushi K.K.); VINYBLAN 2580, 2583, 2641, 2770, 2770H, 2635, 2886, 5202C, and 2706 (trade names, manufactured by Nissin Chemical Industry Co., Ltd.).

Examples of the polyesters include FINETEX ES650, 611, 675, and 850 (trade names, manufactured by Dainippon Ink and Chemicals, Incorporated); WD-size, and WMS (trade names, manufactured by Eastman Chemical Ltd.); A-110, A-115GE, A-120, A-121, A-124GP, A-124S, A-160P, A-210, A-215GE, A-510, A-513E, A-515GE, A-520, A-610, A-613, A-615GE, A-620, WAC-10, WAC-15, WAC-17XC, WAC-20, S-110, S-110EA, S-111SL, S-120, S-140, S-140A, S-250, S-2526, S-250S, S-320, S-680, DNS-63P, NS-122L, NS-122LX, NS-244LX, NS-140L, NS-141LX, and NS-282LX (trade names, manufactured by Takamatsu Yushi K.K.); Aronmelt PES-1000 series, and PES-2000 series (trade names, manufactured by Toagosei Co., Ltd.); Bironal MD-1100, MD-1200, MD-1220, MD-1245, MD-1250, MD-1335, MD-1400, MD-1480, MD-1500, MD-1930, and MD-1985 (trade names, manufactured by Toyobo Co., Ltd.); and Ceporjon ES (trade name, manufactured by Sumitomo Seika Chemicals Co., Ltd.).

Examples of the polyurethanes include HYDRAN AP10, AP20, AP30, AP40, and 101H, Vondic 1320NS and 1610NS (trade names, manufactured by Dainippon Ink and Chemicals, Incorporated); D-1000, D-2000, D-6000, D-4000, and D-9000 (trade names, manufactured by Dainichi Seika Color & Chemicals Mfg. Co., Ltd.); NS-155X, NS-310A, NS-310X, and NS-311X (trade names, manufactured by Takamatsu Yushi K.K.); Elastron (trade name, manufactured by Dai-ichi Kogyo Seiyaku Co., Ltd.).

Examples of the rubbers include LACSTAR 7310K, 3307B, 4700H, and 7132C (trade names, manufactured by Dainippon Ink & Chemicals Incorporated); Nipol Lx416, LX410, LX430, LX435, LX110, LX415A, LX438C, 2507H, LX303A, LX407BP series, V1004, and MH5055 (trade names, manufactured by Nippon Zeon Co., Ltd.).

Examples of the polyvinyl chlorides include G351, and G576 (trade names, manufactured by Nippon Zeon Co., Ltd.); VINYBLAN 240, 270, 277, 375, 386, 609, 550, 601, 602, 630, 660, 671, 683, 680, 680S, 681N, 685R, 277, 380, 381, 410, 430, 432, 860, 863, 865, 867, 900, 900GT, 938, and 950 (trade names, manufactured by Nisshin Chemical Industry Co., Ltd.).

Examples of polyvinylidene chlorides include L502 and L513 (trade names, manufactured by Asahi Kasei Corporation); D-5071 (trade name, manufactured by Dai-Nippon Ink & Chemicals, Inc.).

Examples of polyolefins include Chemipearl S120, SA100, and V300 (P-40: Tg 80° C.) (trade names, manufactured by Mitsui Petrochemical); Voncoat 2830, 2210, and 2960 (trade names, manufactured by Dainippon Ink and Chemicals, Incorporated); Zaikusen and Ceporjon G (trade names, manufactured by Sumitomo Seika Chemicals Co., Ltd.).

Examples of copolymer nylons include Ceporjon PA (trade name, manufactured by Sumitomo Seika Chemicals Co., Ltd.).

Examples of the polyvinyl acetates include VINYBLAN 1080, 1082, 1085W, 1108W, 1108S, 1563M, 1566, 1570, 1588C, A22J7-F2, 1128C, 1137, 1138, A20J2, A23J1, A23J1, A23K$_1$, A23P2E, A68J1N, 1086A, 1086, 1086D, 1108S, 1187, 1241LT, 1580N, 1083, 1571, 1572, 1581, 4465, 4466, 4468W, 4468S, 4470, 4485LL, 4495LL, 1023, 1042, 1060, 1060S, 1080M, 1084W, 1084S, 1096, 1570K, 1050, 1050S, 3290, 1017AD, 1002, 1006, 1008, 1107L, 1225, 1245L, GV-6170, GV-6181, 4468W, and 4468S (trade names, manufactured by Nisshin Chemical Industry Co., Ltd.).

Of these latex polymers, as preferable types of latex polymer for use in the receptor layer in the present invention, there can be preferably used polyvinyl chlorides and a copolymer having a monomer unit of vinyl chloride such as a vinyl chloride-vinyl acetate copolymer and a vinyl chloride acrylate copolymer. In case of the copolymer, the vinyl chloride monomer ratio is preferably in the range of from 50% to 95%. These polymers may be straight-chain, branched, or cross-linked polymers, the so-called homopolymers obtained by polymerizing single type of monomers, or copolymers obtained by polymerizing two or more types of monomers. In the case of the copolymers, these copolymers may be either random copolymers or block copolymers. The number average molecular weight of each of these polymers is preferably 5,000 to 1,000,000, and further preferably 10,000 to 500,000. Polymers having excessively small molecular weight impart insufficient dynamic strength to the layer containing the latex, and polymers having excessively large molecular weight bring about poor filming ability, and therefore both cases are undesirable. Crosslinkable latex polymers are also preferably used.

In the present invention, it is preferable to prepare the receptor layer by applying an aqueous type coating solution and then drying it. The "aqueous type" so-called here means that 60% by mass or more of the solvent (dispersion medium) of the coating solution is water. As components other than water in the coating solution, water miscible organic solvents may be used, such as methyl alcohol, ethyl alcohol, isopropyl alcohol, methyl cellosolve, ethyl cellosolve, dimethylformamide, ethyl acetate, diacetone alcohol, furfuryl alcohol, benzyl alcohol, diethylene glycol monoethyl ether, and oxyethyl phenyl ether.

The minimum film-forming temperature (MFT) of the latex polymer is preferably from −30° C. to 90° C., more preferably from about 0° C. to about 70° C. For the purpose of controlling the minimum film-forming temperature, a film-forming aid may be added. However, it is preferred that at least one latex polymer in the receptor layer be present in a particulate state without forming a film.

The film-forming aid is also called a temporary plasticizer, and it is an organic compound (usually an organic solvent) that reduces the minimum film-forming temperature of a latex polymer. It is described in, for example, Souichi Muroi, "Gosei Latex no Kagaku (Chemistry of Synthetic Latex)", issued by Kobunshi Kanko Kai (1970). Preferable examples of the film-forming aid are listed below, but the compounds that can be used in the present invention are not limited to the following specific examples.

Z-1: Benzyl alcohol

Z-2: 2,2,4-Trimethylpentanediol-1,3-monoisobutyrate

Z-3: 2-Dimethylaminoethanol

Z-4: Diethylene glycol

The latex polymer for use in the present invention may be used together with any polymer. In the present invention, the polymer that can be used in combination with the latex polymer is sometimes referred to as "binder" in order to distinguish it from the latex polymer.

The binder that can be used together with the latex polymers is preferably transparent or translucent, and colorless. Examples of the binder include natural resins, polymers, or copolymers; synthetic resins, polymers, or copolymers; and other film-forming materials, such as gelatins, polyvinyl alcohols, hydroxyethyl celluloses, cellulose acetates, cellulose acetate butyrates, polyvinyl pyrrolidones, caseins, starches, polyacrylic acids, polymethylmethacrylic acids, polyvinyl chlorides, polymethacrylic acids, styrene-maleic anhydride copolymers, styrene-acrylonitrile copolymers, styrene-butadiene copolymers, polyvinyl acetals (e.g., polyvinyl formal and polyvinyl butyral), polyesters, polyurethanes, phenoxy resins, polyvinylidene chlorides, polyepoxides, polycarbonates, polyvinyl acetates, polyolefins, and polyamides. In the coating liquid, a binder may be dissolved or dispersed in an aqueous solvent or in an organic solvent, or may be in the form of an emulsion.

The binder which can be used in the present invention has no particular limitation on its glass transition temperature. This is because the addition amount of the binder is smaller than that of the receptor latex polymer, and thermal properties of the receptor layer rest on the latex polymer.

The latex polymer and the polymer used for the binder for use in the present invention can be easily obtained by a solution polymerization method, a suspension polymerization method, an emulsion polymerization method, a dispersion polymerization method, an anionic polymerization method, a cationic polymerization method, or the like. Above all, an emulsion polymerization method in which the polymer is obtained as a latex is the most preferable. Also, a method is preferable in which the polymer is prepared in a solution, and the solution is neutralized, or an emulsifier is added to the solution, to which water is then added, to prepare an aqueous dispersion by forced stirring. For example, an emulsion polymerization method comprises conducting polymerization under stirring at about 30° C. to about 100° C. (preferably 60° C. to 90° C.) for 3 to 24 hours by using water or a mixed solvent of water and a water-miscible organic solvent (such as methanol, ethanol, or acetone) as a dispersion medium, a monomer mixture in an amount of 5 mass % to 150 mass % based on the amount of the dispersion medium, an emulsifier and a polymerization initiator. Various conditions such as the dispersion medium, the monomer concentration, the amount of initiator, the amount of emulsifier, the amount of dispersant, the reaction temperature, and the method for adding monomers are suitably determined considering the type of the monomers to be used. Furthermore, it is preferable to use a dispersant when necessary.

Generally, the emulsion polymerization method can be conducted according to the disclosures of the following documents: "Gosei Jushi Emarujon (Synthetic Resin Emulsions)" (edited by Taira Okuda and Hiroshi Inagaki and published by Kobunshi Kankokai (1978)); "Gosei Ratekkusu no Oyo (Applications of Synthetic Latexes)" (edited by Takaaki Sugimura, Yasuo Kataoka, Soichi Suzuki, and Keiji Kasahara and published by Kobunshi Kankokai (1993)); and "Gosei Ratekkusu no Kagaku (Chemistry of Synthetic Latexes)" (edited by Soichi Muroi and published by Kobunshi Kankokai (1970)). The emulsion polymerization method for synthesizing the latex polymer for use in the present invention may be a batch polymerization method, a monomer (continuous or divided) addition method, an emulsion addition method, or a seed polymerization method. The emulsion polymerization method is preferably a batch polymerization method, a monomer (continuous or divided) addition method, or an emulsion addition method in view of the productivity of latex.

The polymerization initiator may be any polymerization initiator having radical generating ability. The polymerization initiator to be used may be selected from inorganic peroxides such as persulfates and hydrogen peroxide, peroxides described in the organic peroxide catalogue of NOF Corporation, and azo compounds as described in the azo polymerization initiator catalogue of Wako Pure Chemical Industries, Ltd. Among them, water-soluble peroxides such as persulfates and water-soluble azo compounds as described in the azo polymerization initiator catalogue of Wako Pure Chemical Industries, Ltd. are preferable; ammonium persulfate, sodium persulfate, potassium persulfate, azobis(2-methylpropionamidine) hydrochloride, azobis(2-methyl-N-(2-hydroxyethyl)propionamide), and azobiscyanovaleric acid are more preferable; and peroxides such as ammonium persulfate, sodium persulfate, and potassium persulfate are especially preferable from the viewpoints of image preservability, solubility, and cost.

The amount of the polymerization initiator to be added is, based on the total amount of monomers, preferably 0.3 mass % to 2.0 mass %, more preferably 0.4 mass % to 1.75 mass %, and especially preferably 0.5 mass % to 1.5 mass %.

The polymerization emulsifier to be used may be selected from anionic surfactants, nonionic surfactants, cationic surfactants, and ampholytic surfactants. Among them, anionic surfactants are preferable from the viewpoints of dispersibility and image preservability. Sulfonic acid type anionic surfactants are more preferable because polymerization stability can be ensured even with a small addition amount and they have resistance to hydrolysis. Long chain alkyldiphenyl ether disulfonic acid salts (whose typical example is PELEX SS-H manufactured by Kao Corporation, trade name) are still more preferable, and low electrolyte types such as PIONIN A-43-S (manufactured by Takemoto Oil & Fat Co., Ltd., trade name) are especially preferable.

The amount of sulfonic acid type anionic surfactant as the polymerization emulsifier is preferably 0.1 mass % to 10.0 mass %, more preferably 0.2 mass % to 7.5 mass %, and especially preferably 0.3 mass % to 5.0 mass %, based on the total amount of monomers.

It is preferable to use a chelating agent in synthesizing the latex polymer to be used in the present invention. The chelating agent is a compound capable of coordinating (chelating) a polyvalent ion such as metal ion (e.g., iron ion) or alkaline earth metal ion (e.g., calcium ion), and examples of the chelate compound which can be used include the compounds described in JP-B-6-8956 ("JP-B" means examined Japanese patent publication), U.S. Pat. No. 5,053,322, JP-A-4-73645, JP-A-4-127145, JP-A-4-247073, JP-A-4-305572, JP-A-6-11805, JP-A-5-173312, JP-A-5-66527, JP-A-5-158195, JP-A-6-118580, JP-A-6-110168, JP-A-6-161054, JP-A-6-175299, JP-A-6-214352, JP-A-7-114161, JP-A-7-114154, JP-A-7-120894, JP-A-7-199433, JP-A-7-306504, JP-A-9-43792, JP-A-8-314090, JP-A-10-182571, JP-A-10-182570, and JP-A-11-190892.

Preferred examples of the chelating agent include inorganic chelate compounds (e.g., sodium tripolyphosphate, sodium hexametaphosphate, sodium tetrapolyphosphate), aminopolycarboxylic acid-based chelate compounds (e.g., nitrilotriacetate, ethylenediaminetetraacetate), organic phosphonic acid-based chelate compounds (e.g., compounds described in Research Disclosure, No. 18170, JP-A-52-102726, JP-A-53-42730, JP-A-56-97347, JP-A-54-121127, JP-A-55-4024, JP-A-55-4025, JP-A-55-29883, JP-A-55-126241, JP-A-55-65955, JP-A-55-65956, JP-A-57-179843, JP-A-54-61125, and West German Patent No. 1045373), polyphenol-based chelating agents, and polyamine-based chelate compounds, with aminopolycarboxylic acid derivatives being particularly preferred.

Preferred examples of the aminopolycarboxylic acid derivative include the compounds shown in the Table attached to "EDTA (-Complexane no Kagaku-)(EDTA-Chemistry of Complexane-)", Nankodo (1977). In these compounds, a part of the carboxyl groups may be substituted by an alkali metal salt such as sodium or potassium or by an ammonium salt. More preferred examples of the aminopolycarboxylic acid derivative include iminodiacetic acid, N-methyliminodiacetic acid, N-(2-aminoethyl)iminodiacetic acid, N-(carbamoylmethyl)imino diacetic acid, nitrilotriacetic acid, ethylenediamine-N,N'-diacetic acid, ethylenediamine-N,N'-di-α-propionic acid, ethylenediamine-N,N'-di-β-propionic acid, N,N'-ethylene-bis(α-o-hydroxyphenyl)glycine, N,N'-di(2-hydroxybenzyl)ethylenediamine-N,N'-diacetic acid, ethylenediamine-N,N'-diacetic acid-N,N'-diacetohydroxamic acid, N-hydroxyethylethylenediamine-N,N',N'-triacetic acid, ethylenediamine-N,N,N',N'-tetraacetic acid, 1,2-propylenediamine-N,N,N',N'-tetraacetic acid, d,1-2,3-diaminobutane-N,N,N',N'-tetraacetic acid, meso-2,3-diaminobutane-N,N,N',N'-tetraacetic acid, 1-phenylethylenediamine-N,N,N',N'-tetraacetic acid, d,1-1,2-diphenylethylenediamine-N,N,N',N'-tetraacetic acid, 1,4-diaminobutane-N,N,N',N'-tetraacetic acid, trans-cyclobutane-1,2-diamine-N,N,N',N'-tetraacetic acid, trans-cyclopentane-1,2-diamine-N,N,N',N'-tetraacetic acid, trans-cyclohexane-1,2-diamine-N,N,N',N'-tetraacetic acid, cis-cyclohexane-1,2-diamine-N,N,N',N'-tetraacetic acid, cyclohexane-1,3-diamine-N,N,N',N'-tetraacetic acid, cyclohexane-1,4-diamine-N,N,N',N'-tetraacetic acid, o-phenylenediamine-N,N,N',N'-tetraacetic acid, cis-1,4-diaminobutene-N,N,N', N'-tetraacetic acid, trans-1,4-diaminobutene-N,N,N',N'-tetraacetic acid, α,α'-diamino-o-xylene-N,N,N',N'-tetraacetic acid, 2-hydroxy-1,3-propanediamine-N,N,N',N'-tetraacetic acid, 2,2'-oxy-bis(ethyliminodiacetic acid), 2,2'-ethylenedioxy-bis(ethyliminodiacetic acid), ethylenediamine-N,N'-diacetic acid-N,N'-di-α-propionic acid, ethylenediamine-N,N'-diacetic acid-N,N'-di-β-propionic acid, ethylenediamine-N,N,N',N'-tetrapropionic acid, diethylenetriamine-N,N,N',N'',N''-pentaacetic acid, triethylenetetramine-N,N,N',N'',N''',N'''-hexaacetic acid, and 1,2,3-triaminopropane-N,N,N',N'',N''',N'''-hexaacetic acid. In these compounds, a part of the carboxyl groups may be substituted by an alkali metal salt such as sodium or potassium or by an ammonium salt.

The amount of the chelating agent to be added is preferably 0.01 mass % to 0.4 mass %, more preferably 0.02 mass % to 0.3 mass %, and especially preferably 0.03 mass % to 0.15 mass %, based on the total amount of monomers. When the addition amount of the chelating agent is too small, metal ions entering during the preparation of the latex polymer are not sufficiently trapped, and the stability of the latex against aggregation is lowered, whereby the coating properties become worse. When the amount is too large, the viscosity of the latex increases, whereby the coating properties are lowered.

In the preparation of the latex polymer to be used in the present invention, it is preferable to use a chain transfer agent. As the chain transfer agent, ones described in Polymer Handbook (3rd Edition) (Wiley-Interscience, 1989) are preferable. Sulfur compounds are more preferable because they have high chain-transferability and because the required amount is small. Especially, hydrophobic mercaptane-based chain transfer agents such as tert-dodecylmercaptane and n-dodecylmercaptane are preferable.

The amount of the chain transfer agent to be added is preferably 0.2 mass % to 2.0 mass %, more preferably 0.3 mass % to 1.8 mass %, and especially preferably 0.4 mass % to 1.6 mass %, based on the total amount of monomers.

Besides the foregoing compounds, in the emulsion polymerization, use can be made of additives, such as electrolytes, stabilizers, thickeners, defoaming agents, antioxidants, vulcanizers, antifreezing agents, gelling agents, and vulcanization accelerators, as described, for example, in Synthetic Rubber Handbook.

In the coating solution of the latex polymer to be used in the present invention, an aqueous solvent can be used as the solvent, and a water-miscible organic solvent may optionally be used in combination. Examples of the water-miscible organic solvent include alcohols (for example, methyl alcohol, ethyl alcohol, and propyl alcohol), cellosolves (for example, methyl cellosolve, ethyl cellosolve, and butyl cellosolve), ethyl acetate, and dimethylformamide. The amount of the organic solvent to be added is preferably 50 mass % or less of the entire solvent, more preferably 30 mass % or less of the entire solvent.

Furthermore, in the latex polymer for use in the present invention, the polymer concentration is, based on the amount of the latex liquid, preferably 10 mass % to 70 mass %, more preferably 20 mass % to 60 mass %, and especially preferably 30 mass % to 55 mass %.

The latex polymer in the image-receiving sheet according to the present invention includes a state of a gel or dried film formed by removing a part of solvents by drying after coating.

<Wax>

The receptor layer contains a wax dispersion as a releasing agent. In the present invention, "wax" means an organic compound having an alkyl chain which is in a solid or semisolid state at room temperature (according to the definition given in *Kaitei Wax no Seishitsu to Oyo* (Revised edition, Properties and Applications of Wax), Saiwai Shobo (1989)). Preferable examples of the organic compound include candelilla wax, carnauba wax, rice wax, haze wax, montan wax, ozokerite, paraffin wax, microcrystalline wax, petrolatum, Fischer-Tropsch wax, polyethylene wax, montan wax derivatives, paraffin wax derivatives, microcrystalline wax derivatives, hydrogenated ricinus, hydrogenated ricinus derivatives, 12-hydroxystearic acid, stearic acid amide, phthalic anhydride imide, chlorinated hydrocarbons, and other mixed waxes. Of these waxes, carnauba wax, montan wax and derivatives thereof, paraffin wax and derivatives thereof, microcrystalline wax and derivatives thereof, polyethylene wax and stearic acid amide are preferred, carnauba wax, montan wax and derivatives thereof, microcrystalline wax and stearic acid amide are more preferred, and montan wax, montan wax derivatives and microcrystalline wax are further preferred.

These waxes are selected from waxes having melting points of 25° C. to 120° C., preferably 40° C. to 100° C., more preferably 60° C. to 90° C.

The wax is preferably in a state of being dispersed in water, more preferably in the form of fine particles. Dispersing waxes in water and forming waxes into fine particles can be performed using the methods as described in "Kaitei Wax no Seishitsu to Oyo (Revised version, Properties and Applications of Wax)", Saiwai Shobo (1989).

The addition amount of wax is preferably from 0.5 to 30% by mass, more preferably from 1 to 20% by mass, further preferably from 1.5 to 15% by mass, of the amount of total solid content in the receptor layer.

In addition, it is necessary to adjust the addition amount of wax depending on the kinds of thermoplastic latex polymers used in the receptor layer. The greater the proportion of the latex polymer which has Tg of 50° C. or less to the latex polymer which has Tg more than 50° C., the relatively higher the addition amount of wax is adjusted; while the smaller the proportion, the relatively lower the addition amount of wax is adjusted.

<Water-Soluble Polymer>

The receptor layer preferably contains a water-soluble polymer. Herein, the "water-soluble polymer" means a polymer which dissolves, in 100 g water at 20° C., in an amount of preferably 0.05 g or more, more preferably 0.1 g or more, further preferably 0.5 g or more, and particularly preferably 1 g or more. The water-soluble polymer which can be used in the present invention is natural polymers (polysaccharide type, microorganism type, and animal type), semi-synthetic polymers (cellulose-based, starch-based, and alginic acid-based), and synthetic polymer type (vinyl type and others); and synthetic polymers including polyvinyl alcohols, and natural or semi-synthetic polymers using celluloses derived from plant as starting materials, which will be explained later, correspond to the water-soluble polymer usable in the present invention. The latex polymers recited above are not included in the water-soluble polymers which can be used in the present invention.

Among the water-soluble polymers which can be used in the present invention, the natural polymers and the semi-synthetic polymers will be explained in detail. Specific examples include the following polymers: plant type polysaccharides such as gum arabics, κ-carrageenans, l-carrageenans, λ-carrageenans, guar gums (e.g. Supercol, manufactured by Squalon), locust bean gums, pectins, tragacanths, corn starches (e.g. Purity-21, manufactured by National Starch & Chemical Co.), and phosphorylated starches (e.g. National 78-1898, manufactured by National Starch & Chemical Co.); microbial type polysaccharides such as xanthan gums (e.g. Keltrol T, manufactured by Kelco) and dextrins (e.g. Nadex 360, manufactured by National Starch & Chemical Co.); animal type natural polymers such as gelatins (e.g. Crodyne B419, manufactured by Croda), caseins, sodium chondroitin sulfates (e.g. Cromoist CS, manufactured by Croda); cellulose-based polymers such as ethylcelluloses (e.g. Cellofas WLD, manufactured by I.C.I.), carboxymethylcelluloses (e.g. CMC, manufactured by Daicel), hydroxyethylcelluloses (e.g. HEC, manufactured by Daicel), hydroxypropylcelluloses (e.g. Klucel, manufactured by Aqualon), methylcelluloses (e.g. Viscontran, manufactured by Henkel), nitrocelluloses (e.g. Isopropyl Wet, manufactured by Hercules), and cationated celluloses (e.g. Crodacel QM, manufactured by Croda); starches such as phosphorylated starches (e.g. National 78-1898, manufactured by National Starch & Chemical Co.); alginic acid-based compounds such as sodium alginates (e.g. Keltone, manufactured by Kelco) and propylene glycol alginates; and other polymers such as cationated guar gums (e.g. Hi-care 1000, manufactured by Alcolac) and sodium hyaluronates (e.g. Hyalure, manufactured by Lifecare Biomedial) (all of the names are trade names).

Among the water-soluble polymers which can be used in the present invention, the synthetic polymers will be explained in detail. Examples of the acryl type include sodium polyacrylates, polyacrylic acid copolymers, polyacrylamides, polyacrylamide copolymers, and polydiethylaminoethyl(meth)acrylate quaternary salts or their copolymers. Examples of the vinyl type include polyvinylpyrrolidones, polyvinylpyrrolidone copolymers, and polyvinyl alcohols. Examples of the others include polyethylene glycols, polypropylene glycols, polyisopropylacrylamides, polymethyl vinyl ethers, polyethyleneimines, polystyrenesulfonic acids or their copolymers, naphthalenesulfonic acid condensate salts, polyvinylsulfonic acids or their copolymers, polyacrylic acids or their copolymers, acrylic acid or its copolymers, maleic acid copolymers, maleic acid monoester copolymers, acryloylmethylpropanesulfonic acid or its copolymers, polydimethyldiallylammonium chlorides or their copolymers, polyamidines or their copolymers, polyimidazolines, dicyanamide type condensates, epichlorohydrin/dimethylamine condensates, Hofmann decomposed products of polyacrylamides, and water-soluble polyesters (Plascoat Z-221, Z-446, Z-561, Z-450, Z-565, Z-850, Z-3308, RZ-105, RZ-570, Z-730 and RZ-142 (all of these names are trade names), manufactured by Goo Chemical Co., Ltd.).

In addition, highly-water-absorptive polymers, namely, homopolymers of vinyl monomers having —COOM or —$SO_3M$ (M represents a hydrogen atom or an alkali metal) or copolymers of these vinyl monomers among them or with other vinyl monomers (for example, sodium methacrylate, ammonium methacrylate, Sumikagel L-5H (trade name) manufactured by Sumitomo Chemical Co., Ltd.) as described in, for example, U.S. Pat. No. 4,960,681 and JP-A-62-245260, may also be used.

Of the water-soluble synthetic polymers usable in the present invention, the polyvinyl alcohols are explained in further detail.

Examples of completely saponificated polyvinyl alcohol include PVA-105 [polyvinyl alcohol (PVA) content: 94.0 mass % or more; degree of saponification: 98.5±0.5 mol %; content of sodium acetate: 1.5 mass % or less; volatile constituent: 5.0 mass % or less; viscosity (4 mass %; 20° C.): 5.6±0.4 CPS]; PVA-110 [PVA content: 94.0 mass %; degree of saponification: 98.5±0.5 mol %; content of sodium acetate: 1.5 mass %; volatile constituent: 5.0 mass %; viscosity (4 mass %; 20° C.): 11.0±0.8 CPS]; PVA-117 [PVA content: 94.0 mass %; degree of saponification: 98.5±0.5 mol %; content of sodium acetate: 1.0 mass %; volatile constituent: 5.0 mass %; viscosity (4 mass %; 20° C.): 28.0±3.0 CPS]; PVA-117H [PVA content: 93.5 mass %; degree of saponification: 99.6±0.3 mol %; content of sodium acetate: 1.85 mass %; volatile constituent: 5.0 mass %; viscosity (4 mass %; 20° C.): 29.0±3.0 CPS]; PVA-120 [PVA content: 94.0 mass %; degree of saponification: 98.5±0.5 mol %; content of sodium acetate: 1.0 mass %; volatile constituent: 5.0 mass %; viscosity (4 mass %; 20° C.): 39.5±4.5 CPS]; PVA-124 [PVA content: 94.0 mass %; degree of saponification: 98.5±0.5 mol %; content of sodium acetate: 1.0 mass %; volatile constituent: 5.0 mass %; viscosity (4 mass %; 20° C.): 60.0±6.0 CPS]; PVA-124H [PVA content: 93.5 mass %; degree of saponification: 99.6±0.3 mol %; content of sodium acetate: 1.85 mass %; volatile constituent: 5.0 mass %; viscosity (4 mass %; 20° C.): 61.0±6.0 CPS]; PVA-CS [PVA content: 94.0 mass %; degree of saponification: 97.5±0.5 mol %; content of sodium acetate: 1.0 mass %; volatile constituent: 5.0 mass %; viscosity (4 mass %; 20° C.): 27.5±3.0 CPS]; PVA-CST [PVA content: 94.0 mass %; degree of saponification: 96.0±0.5 mol %; content of sodium acetate: 1.0 mass %; volatile constituent: 5.0 mass %; viscosity (4 mass %; 20° C.): 27.0±3.0 CPS]; and PVA-HC [PVA content: 90.0 mass %; degree of saponification: 99.85 mol % or more; content of sodium acetate: 2.5 mass %; volatile constituent: 8.5 mass %; viscosity (4 mass %; 20° C.): 25.0±3.5 CPS] (all trade names, manufactured by Kuraray Co., Ltd.), and the like.

Examples of partially saponificated polyvinyl alcohol include PVA-203 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.4±0.2 CPS]; PVA-204 [PVA content: 94.0 mass %; degree of saponification: 88.0±1.5 mol %; content of sodium acetate: 1.0 mass %; volatile constituent: 5.0 mass %; viscosity (4 mass %; 20° C.): 3.9±0.3 CPS]; PVA-205 [PVA content: 94.0 mass %; degree of saponification: 88.0±1.5 mol %; content of sodium acetate: 1.0 mass %; volatile constituent: 5.0 mass %; viscosity (4 mass %; 20° C.): 5.0±0.4 CPS]; PVA-210 [PVA content: 94.0 mass %; degree of saponification: 88.0±1.0 mol %; content of sodium acetate: 1.0 mass %; volatile constituent: 5.0 mass %; viscosity (4 mass %; 20° C.): 9.0±1.0 CPS]; PVA-217 [PVA content: 94.0 mass %; degree of saponification: 88.0±1.0 mol %; content of sodium acetate: 1.0 mass %; volatile constituent: 5.0 mass %; viscosity (4 mass %; 20° C.): 22.5±2.0 CPS]; PVA-220 [PVA content: 94.0 mass %; degree of saponification: 88.0±1.0 mol %; content of sodium acetate: 1.0 mass %; volatile constituent: 5.0 mass %; viscosity (4 mass %; 20° C.): 30.0±3.0 CPS]; PVA-224 [PVA content: 94.0 mass %; degree of saponification: 88.0±1.5 mol %; content of sodium acetate: 1.0 mass %; volatile constituent: 5.0 mass %; viscosity (4 mass %; 20° C.): 44.0±4.0 CPS]; PVA-228 [PVA content: 94.0 mass %; degree of saponification: 88.0±1.5 mol %; content of sodium acetate: 1.0 mass %; volatile constituent: 5.0 mass %; viscosity (4 mass %; 20° C.): 65.0±5.0 CPS]; PVA-235 [PVA content: 94.0 mass %; degree of saponification: 88.0±1.5 mol %; content of sodium acetate: 1.0 mass %; volatile constituent: 5.0 mass %; viscosity (4 mass %; 20° C.): 95.0±15.0 CPS]; PVA-217EE [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-217E [PVA content: 94.0 mass %; degree of saponification: 88.0±1.0 mol %; content of sodium acetate: 1.0 mass %; volatile constituent: 5.0 mass %; viscosity (4 mass %; 20° C.): 23.0±3.0 CPS]; PVA-220E [PVA content: 94.0 mass %; degree of saponification: 88.0±1.0 mol %; content of sodium acetate: 1.0 mass %; volatile constituent: 5.0 mass %; viscosity (4 mass %; 20° C.): 31.0±4.0 CPS]; PVA-224E [PVA content: 94.0 mass %; degree of saponification: 88.0±1.0 mol %; content of sodium acetate: 1.0 mass %; volatile constituent: 5.0 mass %; viscosity (4 mass %; 20° C.): 45.0±5.0 CPS]; PVA-403 [PVA content: 94.0 mass %; degree of saponification: 80.0±1.5 mol %; content of sodium acetate: 1.0 mass %; volatile constituent: 5.0 mass %; viscosity (4 mass %; 20° C.): 3.1±0.3 CPS]; PVA-405 [PVA content: 94.0 mass %; degree of saponification: 81.5±1.5 mol %; content of sodium acetate: 1.0 mass %; volatile constituent: 5.0 mass %; viscosity (4 mass %; 20° C.): 4.8±0.4 CPS]; PVA-420 [PVA content: 94.0 mass %; degree of saponification: 79.5±1.5 mol %; content of sodium acetate: 1.0 mass %; volatile constituent: 5.0 mass %]; PVA-613 [PVA content: 94.0 mass %; degree of saponification: 93.5±1.0 mol %; content of sodium acetate: 1.0 mass %; volatile constituent: 5.0 mass %; viscosity (4 mass %; 20° C.): 16.5±2.0 CPS]; L-8 [PVA content: 96.0 mass %; degree of saponification: 71.0±1.5 mol %; content of sodium acetate: 1.0 mass % (ash); volatile constituent: 3.0 mass %; viscosity (4 mass %; 20° C.): 5.4±0.4 CPS] (all trade names, manufactured by Kuraray Co., Ltd.), and the like.

The above values were measured in the manner described in JIS K-6726-1977.

With respect to modified polyvinyl alcohols, those described in Koichi Nagano, et al., "Poval", Kobunshi Kankokai, Inc. are useful. The modified polyvinyl alcohols include polyvinyl alcohols modified by cations, anions, —SH compounds, alkylthio compounds, or silanols.

Examples of such modified polyvinyl alcohols (modified PVA) include C polymers such as C-118, C-318, C-318-2A, and C-506 (all being trade names of Kuraray Co., Ltd.); HL polymers such as HL-12E and HL-1203 (all being trade names of Kuraray Co., Ltd.); HM polymers such as HM-03 and HM-N-03 (all being trade names of Kuraray Co., Ltd.); K polymers such as KL-118, KL-318, KL-506, KM-118T, and KM-618 (all being trade names of Kuraray Co., Ltd.); M polymers such as M-115 (a trade name of Kuraray Co., Ltd.); MP polymers such as MP-102, MP-202, and MP-203 (all being trade names of Kuraray Co., Ltd.); MPK polymers such as MPK-1, MPK-2, MPK-3, MPK-4, MPK-5, and MPK-6 (all being trade names of Kuraray Co., Ltd.); R polymers such as R-1130, R-2105, and R-2130 (all being trade names of Kuraray Co., Ltd.); and V polymers such as V-2250 (a trade name of Kuraray Co., Ltd.).

The viscosity of polyvinyl alcohol can be adjusted or stabilized by adding a trace amount of a solvent or an inorganic salt to an aqueous solution of polyvinyl alcohol, and there can be employed compounds described in the aforementioned reference "Poval", Koichi Nagano et al., published by Kobunshi Kankokai, pp. 144-154. For example, a coated surface quality can be improved by an addition of boric acid. The amount of boric acid added is preferably 0.01 to 40 mass % with respect to polyvinyl alcohol.

Preferred binders are transparent or semitransparent, generally colorless, and water-soluble. Examples include natural resins, polymers and copolymers; synthetic resins, polymers, and copolymers; and other media that form films: for example, rubbers, polyvinyl alcohols, hydroxyethyl celluloses, cellulose acetates, cellulose acetate butylates, polyvinylpyrrolidones, starches, polyacrylic acids, polymethyl methacrylates, polyvinyl chlorides, polymethacrylic acids, styrene/maleic acid anhydride copolymers, styrene/acrylonitrile copolymers, styrenelbutadiene copolymers, polyvinylacetals (e.g., polyvinylformals and polyvinylbutyrals), polyesters, polyurethanes, phenoxy resins, polyvinylidene chlorides, polyepoxides, polycarbonates, polyvinyl acetates, polyolefins, cellulose esters, and polyamides.

The amount of the water-soluble polymer added to the receptor layer is preferably from 1 to 25% by mass, more preferably from 1 to 10% by mass based on the entire receptor layer.

<Crosslinking Agent>

The receptor layer preferably contains a crosslinking agent (compound capable of crosslinking a water-soluble polymer). It is preferable that the above-mentioned water-soluble polymer contained in the receptor layer is partly or entirely crosslinked with the crosslinking agent.

The crosslinking agent is required to have a plurality of groups capable of reacting with an amino group, a carboxyl group, a hydroxyl group or the like, but the agent to be used may be suitably selected depending on the kind of the water-soluble polymer. Thus, there is no particular limitation for the kind of the crosslinking agent. It is suitable to use each of methods described in T. H. James; "THE THEORY OF THE PHOTOGRAPHIC PROCESS FOURTH EDITION", published by Macmillan Publishing Co., Inc. (1977), pp. 77 to 87, and crosslinking agents described in, for example, U.S. Pat. No. 4,678,739, col. 41; JP-A-59-116655, JP-A-62-245261, and JP-A-61-18942. Both crosslinking agents of an inorganic compound (e.g., chrome alum, boric acid and salts thereof)

and crosslinking agents of an organic compound may be preferably used. Alternatively, the crosslinking agent to be used may be a mixture solution containing a chelating agent and a zirconium compound, whose pH is in the range of 1 to 7, as described in JP-A-2003-231775.

Specific examples of the crosslinking agent include epoxy-series compounds (e.g., diglycidyl ethyl ether, ethyleneglycol diglycidyl ether, 1,4-butanediol diglycidyl ether, 1,6-diglycidyl cyclohexane, N,N-diglycidyl-4-glycidyloxyaniline, sorbitol polyglycidyl ether, glycerol polyglycidyl ether, compounds described in JP-A-6-329877, JP-A-7-309954 and the like, and DIC FINE EM-60 (trade name, munufactured by DAINIPPON INK AND CHEMICALS, INCORPORATED)), aldehyde-series compounds (e.g., formaldehyde, glyoxal, glutalaldehyde), active halogen-series compounds (e.g., 2,4-dichloro-4-hydroxy-1,3,5-s-triazine, and compounds described in U.S. Pat. No. 3,325,287 and the like), active vinyl-series compounds (e.g., 1,3,5-trisacryloyl-hexahydro-s-triazine, bisvinylsulfonylmethyl ether, N,N'-ethylene-bis(vinylsulfonylacetamido)ethane, and compounds described in JP-B-53-41220, JP-B-53-57257, JP-B-59-162546, JP-B-60-80846 and the like), mucohalogen acid compounds (e.g., mucochloric acid), N-carbamoylpyridinium salt compounds (e.g., (1-morpholinocarbonyl-3-pyridinio)methanesulfonate), haloamidinium salt compounds (e.g., 1-(1-chloro-1-pyridinomethylene)pyrrolidinium, 2-naphthalenesulfonate), N-methylol-series compounds (e.g., dimethylolurea, methyloldimethylhydantoin), carbodiimido compounds (e.g., polycarbodiimido compounds derived from isoholondiisocyanate as described in JP-A-59-187029 and JP-B-5-27450, carbodiimido compounds derived from tetramethylxylylene diisocyanate as described in JP-A-7-330849, multi-branch type carbodiimido compounds described in JP-A-10-30024, carbodiimido compounds derived from dicyclohexylmethane diisocyanate as described in JP-A-2000-7642, and CARBODILITE V-02, V-02-L2, V-04, V-06, E-01 and E-02 (trade names, manufactured by Nisshinbo Industries, Inc.)), oxazoline compounds (e.g., oxazoline compounds described in JP-A-2001-215653 and EPOCROS K-1010E, K-1020E, K-1030E, K-2010E, K-2020E, K-2030E, WS-500 and WS-700 (trade names, manufactured by NIPPON SHOKUBAI CO., LTD.)), isocyanate compounds (e.g., dispersible isocyanate compounds described in JP-A-7-304841, JP-A-8-277315, JP-A-10-45866, JP-A-9-71720, JP-A-9-328654, JP-A-9-104814, JP-A-2000-194045, JP-A-2000-194237 and JP-A-2003-64149, and Duranate WB40-100, WB40-80D, WT20-100 and WT30-100 (trade names, manufactured by Asahi Kasei Corporation), CR-60N (trade name, manufactured by DAINIPPON INK AND CHEMICALS; INCORPORATED)), polymer (high molecular) hardeners (e.g., compounds described in JP-A-62-234157 and the like); boric acid and salts thereof, borax, and alum.

Preferable compounds as the crosslinking agent include epoxy-series compounds, aldehyde-series compounds, active halogen-series compounds, active vinyl-series compounds, N-carbamoylpyridinium salt compounds, N-methylol-series compounds (e.g., dimethylolurea, methyloldimethylhydantoin), carbodiimido compounds, oxazoline compounds, isocyanate compounds, polymer hardeners (e.g., compounds described in JP-A-62-234157 and the like), boric acid and salts thereof, borax, and alum. More preferable crosslinking agent include epoxy-series compounds, active halogen-series compounds, active vinyl-series compounds, N-carbamoylpyridinium salt compounds, N-methylol-series compounds (e.g., dimethylolurea, methyloldimethylhydantoin), polymer hardeners (e.g., compounds described in JP-A-62-234157 and the like) and boric acid. The above-mentioned crosslinking agent may be used singly or in combination of two or more.

The crosslinking agent that can be used in the present invention may be added to the water-soluble polymer solution in advance, or may be added at the last step for the preparation of the coating solution. Alternatively, the crosslinking agent may be added just before the coating.

The water-soluble polymer in the receptor layer is preferably cross-linked in a ratio of from 0.1 to 20 mass %, more preferably from 1 to 10 mass % of the entire water-soluble polymer, though the ratio varies depending on the kind of the crosslinking agent.

The addition amount of the crosslinking agent that can be used in the present invention varies depending on the kinds of the water-soluble binder and the crosslinking agent, but it is preferable that the amount is approximately in the range of from 0.1 to 50 mass parts, more preferably from 0.5 to 20 mass parts, and further more preferably from 1 to 10 mass parts, based on 100 mass parts of the water-soluble polymer contained in the constituting layer.

<Emulsified Dispersion>

In the present invention, it is preferred that the receptor layer contain an emulsified dispersion (emulsion). Such an embodiment is especially preferred in the case of using the latex polymer.

The term "emulsification" as used herein follows the commonly used definition. According to "Kagaku Daijiten (ENCYCLOPEDIA CHIMICA)", Kyoritsu Shuppan Co., Ltd., for example, "emulsification" is defined as "a phenomenon in which, in one liquid, another liquid which does not dissolve in the first liquid are dispersed as fine globules, to form an emulsion". In addition, the term "emulsified dispersion" refers to "a dispersion in which fine globules of one liquid are dispersed in another liquid which does not dissolve the globules". The "emulsified dispersion" preferred in the present invention is "a dispersion of oil globules in water". The content of an emulsified dispersion in the image-receiving sheet of the present invention is preferably from 0.03 g/m$^2$ to 25.0 g/m$^2$, more preferably from 1.0 g/m$^2$ to 20.0 g/m$^2$.

In the present invention, it is preferable that a high-boiling solvent be included as an oil-soluble substance in the emulsified dispersion. Examples of the high-boiling solvent preferably used include phthalic acid esters (such as dibutyl phthalate, dioctyl phthalate, and di-2-ethyl-hexyl phthalate), phosphoric or phosphonic acid esters (such as triphenyl phosphate, tricresyl phosphate, tri-2-ethylhexyl phosphate), fatty acid esters (such as di-2-ethylhexyl succinate and tributyl citrate), benzoic acid esters (such as 2-ethylhexyl benzoate and dodecylbenzoate), amides (such as N,N-diethyldodecanamide and N, N-dimethyloleinamide), alcohol and phenol compounds (such as isostearyl alcohol and 2,4-di-tert-amylphenol), anilines (such as N,N-dibutyl-2-butoxy-5-tert-octylaniline), chlorinated paraffins, hydrocarbons (such as dodecylbenzene and diisopropylnaphthalene), and carboxylic acids (such as 2-(2,4-di-tert-amylphenoxy)butyric acid). Of these high-boiling solvents, phosphoric or phosphonic acid esters (such as triphenyl phosphate, tricresyl phosphate, and tri-2-ethylhexyl phosphate) are preferred over the others. In addition to such a high-boiling solvent, an organic solvent having a boiling point of 30° C. to 160° C. (such as ethyl acetate, butyl acetate, methyl ethyl ketone, cyclohexanone, methyl cellosolve acetate, or dimethylformamide) may be used as an auxiliary solvent. The content of high-boiling solvent in the emulsified dispersion is preferably from 3.0 to 25% by mass, and more preferably from 5.0 to 20% by mass.

It is preferable that the emulsified dispersion further contain an agent for imparting fastness to images and an ultraviolet absorbent. The compounds preferably used as such agents are any of the compounds represented by formulae (B), (Ph), (E-1) to (E-3), (TS-I) to (TS-VII), (TS-VIIIA), (UA) to (UE) disclosed in JP-A-2004-361936. Further, homopolymers or copolymers insoluble in water and soluble in organic solvents (preferably the compounds disclosed in JP-A-2004-361936, paragraph Nos. 0208 to 0234) may be included therein.

<Plasticizer>

For the purpose of enhancing the sensitivity of the receptor layer, a plasticizer (high-boiling organic solvent) may also be added. Examples of such a plasticizer include compounds generally used as plasticizers for vinyl chloride resins, and more specifically monomeric plasticizers such as phthalates, phosphates, adipates, and sebacates, and polyester-type plasticizers produced by polymerization of adipic acid or sebacic acid and polyethylene glycol. Although the former plasticizers are generally low in molecular weight, olefin-type special copolymer resins, which are used as polymeric plasticizer usable for vinyl chloride, may be used. Examples of resins usable for such a purpose include products marketed under the names of ELVALOY 741, ELVALOY 742, ELVALOY HP443, ELVALOY HP553, ELVALOY EP4015, ELVALOY EP4043, ELVALOY EP4051 (trade names, manufactured by DuPont-Mitsui Polychemicals Co., Ltd.). Such plasticizers can be added to the resins in a proportion of about 100% by mass based on the resins in the receptor layer, but it is appropriate to use them in a proportion of 30% by mass or below in view of bleeding of prints. When the latex polymer is used, it is preferable that those plasticizers are used in a state of the emulsified dispersion as mentioned above.

<Ultraviolet Absorber>

Also, in the present invention, in order to improve light resistance, an ultraviolet absorber may be added to the receptor layer. In this case, when this ultraviolet absorber is made to have a higher molecular weight, it can be secured to the receptor layer so that it can be prevented, for instance, from being diffused into the ink sheet and from being sublimated and vaporized by heating.

As the ultraviolet absorber, compounds having various ultraviolet absorber skeletons, which are widely used in the field of information recording, may be used. Specific examples of the ultraviolet absorber may include compounds having a 2-hydroxybenzotriazole type ultraviolet absorber skeleton, 2-hydroxybenzotriazine type ultraviolet absorber skeleton, or 2-hydroxybenzophenon type ultraviolet absorber skeleton. Compounds having a benzotriazole-type or triazine-type skeleton are preferable from the viewpoint of ultraviolet absorbing ability (absorption coefficient) and stability, and compounds having a benzotriazole-type or benzophenone-type skeleton are preferable from the viewpoint of obtaining a higher-molecular weight and using in a form of a latex. Specifically, ultraviolet absorbers described in, for example, JP-A-2004-361936 may be used.

The ultraviolet absorber preferably absorbs light at wavelengths in the ultraviolet region, and the absorption edge of the absorption of the ultraviolet absorber is preferably out of the visible region. Specifically, when it is added to the receptor layer to form a heat-sensitive transfer image-receiving sheet, the heat-sensitive transfer image-receiving sheet has a reflection density of, preferably, Abs 0.5 or more at 370 nm, and more preferably Abs 0.5 or more at 380 nm. Also, the heat-sensitive transfer image-receiving sheet has a reflection density of, preferably, Abs 0.1 or less at 400 nm. If the reflection density at a wavelength range exceeding 400 nm is high, it is not preferable because an image is made yellowish.

In the present invention, the ultraviolet absorber is preferably made to have a higher molecular weight. The ultraviolet absorber has a mass average molecular weight of preferably 10,000 or more, and more preferably 100,000 or more. As a means of obtaining a higher-molecular weight ultraviolet absorber, it is preferable to graft an ultraviolet absorber on a polymer. The polymer as the principal chain preferably has a polymer skeleton less capable of being dyed than the receptor polymer to be used together. Also, when the polymer is used to form a film, the film preferably has sufficient film strength. The graft ratio of the ultraviolet absorber to the polymer principal chain is preferably 5 to 20% by mass and more preferably 8 to 15% by mass.

Also, it is more preferable that the ultraviolet-absorber-grafted polymer is made to be used in a form of a latex. Use of the polymer in a form of a latex enables formation of the receptor layer by application and coating of an aqueous dispersion-system coating solution, and this enables reduction of production cost. As a method of making the latex polymer (or making the latex polymer-wise), a method described in, for example, Japanese Patent No. 3,450,339 may be used. As the ultraviolet absorber to be used in a form of a latex, the following commercially available ultraviolet absorbers may be used which include ULS-700, ULS-1700, ULS-1383MA, ULS-1635 MH, XL-7016, ULS-933LP, and ULS-935LH, manufactured by Ipposha Oil Industries Co., Ltd.; and New Coat UVA-1025W, New Coat UVA-204W, and New Coat UVA-4512M, manufactured by Shin-Nakamura Chemical Co., Ltd. (all of these names are trade names).

In the case of using an ultraviolet-absorber-grafted polymer in a form of a latex, it may be mixed with a latex of the receptor polymer capable of being dyed, and the resulting mixture is coated. By doing so, a receptor layer, in which the ultraviolet absorber is homogeneously dispersed, can be formed.

The addition amount of the ultraviolet-absorber-grafted polymer or its latex is preferably 5 to 50 parts by mass, and more preferably 10 to 30 parts by mass, to 100 parts by mass of the receptor latex polymer capable of being dyed to be used to form the receptor layer.

<Auxiliary Releasing Agent>

For the purpose of preventing the image-receiving sheet from thermally sticking (welding) on a heat-sensitive transfer sheet at the time of image formation, a releasing agent as an auxiliary of wax can also be mixed in the receptor layer. As the releasing agent, a silicone oil, a phosphate-based plasticizer, or a fluorine-series compound may be used, and the silicone oil is particularly preferably used. As the silicone oil, modified silicone oil, such as epoxy-modified, alkyl-modified, amino-modified, carboxyl-modified, alcohol-modified, fluorine-modified, alkyl aralkyl polyether-modified, epoxy/polyether-modified, or polyether-modified silicone oil, is preferably used. Among these, a reaction product between vinyl-modified silicone oil and hydrogen-modified silicone oil is preferable.

The amount of the receptor layer to be applied is preferably 0.5 to 10 g/m$^2$ (solid basis, hereinafter, the amount to be applied in the present specification means a value on solid basis unless otherwise noted). The film thickness of the receptor layer is preferably 1 to 20 μm.

The receptor layer can be cast by extrusion coating of a melt of the polymer resin as recited above without resorting to solvent coating. The techniques of this extrusion coating are described in "Encyclopedia of Polymer Science and Engineering", vol. 3, p. 563, John Wiley, New York (1985), and ibid., vol. 6, p. 608 (1986). In addition, a technique for heat-sensitive dye transfer materials is disclosed in JP-A-7-179075, and it is also applicable to the present invention. As the polymer resin, a copolymer obtained by condensing cyclohexane dicarboxylate and a 50:50 mixture (in mol %) of ethylene glycol and bisphenol-A-diethanol (COPOL; trade mark) is especially preferred.

(Heat Insulation Layer)

The heat insulation layer inhibits heat diffusion into the support across an ink sheet and a receptor layer at the time of heat transfer using a thermal head, and contributes to an increase in amounts of transferred dyes. Further, it plays a role of a heat protector for the support. Also, because the heat insulation layer has high cushion characteristics, a heat-sensitive transfer image-receiving sheet having high printing sensitivity can be obtained even in the case of using paper as a substrate (support). The heat insulation layer may be a single layer, or multi-layers. The heat insulation layer is arranged at a nearer location to the support than the receptor layer.

The image-receiving sheet of the present invention preferably has a heat insulation layer having a microvoid structure. Such a heat insulation layer can be provided by use of a microvoid-bearing polymer film. The microvoid-bearing polymer film is commercially available, and examples are Toyo Pearl (Toyobo Co., Ltd.), Lumirror (Toray Industries Inc.) and Yupo (Yopo Corporation). These films are known to be formed by introducing void initiators into polymer matrixes and subjecting the resulting polymer matrixes to biaxial stretching. Alternatively, the heat insulation layer can be formed of a layer containing hollow polymer particles.

The hollow polymer particles in the present invention are polymer particles having independent pores inside of the particles. Examples of the hollow polymer particles include (1) non-foaming type hollow particles obtained in the following manner: water is contained inside of a capsule wall formed of a polystyrene, acryl resin, or styrene/acryl resin and, after a coating solution is applied and dried, the water in the particles is vaporized out of the particles, with the result that the inside of each particle forms a hollow; (2) foaming type microballoons obtained in the following manner: a low-boiling point liquid such as butane and pentane is encapsulated in a resin constituted of any one of polyvinylidene chloride, polyacrylonitrile, polyacrylic acid and polyacrylate, and their mixture or polymer, and after the resin coating material is applied, it is heated to expand the low-boiling point liquid inside of the particles whereby the inside of each particle is made to be hollow; and (3) microballoons obtained by foaming the above (2) under heating in advance, to make hollow polymer particles.

These hollow polymer particles preferably have a hollow ratio of about 20 to 70%, and may be used in combinations of two or more. Specific examples of the above (1) include Rohpake 1055 manufactured by Rohm and Haas Co.; Boncoat PP-1000 manufactured by Dainippon Ink and Chemicals, Incorporated; SX866(B) manufactured by JSR Corporation; and Nippol MH5055 manufactured by Nippon Zeon (all of these product names are trade names). Specific examples of the above (2) include F-30 and F-50 manufactured by Matsumoto Yushi-Seiyaku Co., Ltd. (all of these product names are trade names). Specific examples of the above (3) include F-30E manufactured by Matsumoto Yushi-Seiyaku Co., Ltd, and Expancel 461 DE, 551 DE and 551 DE20 manufactured by Nippon Ferrite (all of these product names are trade names). The hollow polymer particles for use in the heat insulation layer may be a latex thereof.

A water-dispersible resin or water-soluble type resin is preferably contained, as a binder, in the heat insulation layer containing the hollow polymer particles. As the binder resin that can be used in the present invention, known resins such as an acryl resin, styrene/acryl copolymer, polystyrene resin, polyvinyl alcohol resin, vinyl acetate resin, ethylene/vinyl acetate copolymer, vinyl chloride/vinyl acetate copolymer, styrene/butadiene copolymer, polyvinylidene chloride resin, cellulose derivative, casein, starch, and gelatin may be used. Also, these resins may be used either singly or as mixtures.

The solid content of the hollow polymer particles in the heat insulation layer preferably falls in a range from 5 to 2,000 parts by mass when the solid content of the binder resin is 100 parts by mass. The solid content of the hollow polymer particles is preferably 50% by mass or more, more preferably 60% by mass or more, and further preferably 60% by mass or more, based on the total solid content of the hollow polymer particles and the binder resin. Also, the ratio by mass of the solid content of the hollow polymer particles in the coating solution is preferably 1 to 70% by mass and more preferably 10 to 40% by mass. If the ratio of the hollow polymer particles is excessively low, sufficient heat insulation cannot be obtained, whereas if the ratio of the hollow polymer particles is excessively large, the adhesion between the hollow polymer particles is reduced, posing problems, for example, powder fall or film separation.

The particle size of the hollow polymer particles is preferably 0.1 to 20 μm, more preferably 0.1 to 2 μm and particularly preferably 0.1 to 1 μm. Also, the glass transition temperature (Tg) of the hollow polymer particles is preferably 70° C. or more and more preferably 100° C. or more.

The heat insulation layer of the heat-sensitive transfer image-receiving sheet according to the present invention is preferably free of any resins having poor resistance to an organic solvent, except for the hollow polymer particles. Incorporation of the resin having poor resistance to an organic solvent (resin having a dye-dyeing affinity or resin capable of being dyed) in the heat insulation layer is not preferable in view of increase in loss of image definition after image transfer. It is assumed that the color-edge definition loss increases by the reason that owing to the presence of both the resin having a dye-dyeing affinity and the hollow polymer particles in the heat insulation layer, a transferred dye that has dyed the receptor layer migrates through the heat insulation layer adjacent thereto at the lapse of time.

Herein, the term "poor resistance to an organic solvent" means that a solubility in an organic solvent is 1 mass % or more, preferably 0.5 mass % or more. For example, the above-mentioned latex polymer is included in the category of the resin having "poor resistance to an organic solvent".

The heat insulation layer preferably contains the above-mentioned water-soluble polymer. Preferable compounds of the water-soluble polymer are the same as mentioned above.

An amount of the water-soluble polymer to be added in the heat insulation layer is preferably from 1 to 75 mass %, more preferably from 1 to 50 mass % of the entire heat insulation layer.

The heat insulation layer preferably contains a gelatin. The amount of the gelatin in the coating solution for the heat insulation layer is preferably 0.5 to 14% by mass, and particularly preferably 1 to 6% by mass. Also, the coating amount of the above hollow polymer particles in the heat insulation layer is preferably 1 to 100 g/m$^2$, and more preferably 5 to 20 g/m$^2$.

The water-soluble polymer that is contained in the heat insulation layer is preferably cross-linked by a crosslinking agent. Preferable compounds as well as a preferable amount of the crosslinking agent to be used are the same as mentioned above.

A preferred ratio of a cross-linked water-soluble polymer in the heat insulation layer varies depending on the kind of the crosslinking agent, but the water-soluble polymer in the heat insulation layer is crosslinked by preferably 0.1 to 20 mass %, more preferably 1 to 10 mass %, based on the entire water-soluble polymer.

A thickness of the heat insulation layer containing the hollow polymer particles is preferably from 5 to 50 μm, more preferably from 5 to 40 μm.

(Undercoat Layer)

An undercoat layer may be formed between the receptor layer and the heat insulation layer. As the undercoat layer, for example, a white background regulation layer, a charge regulation layer, an adhesive layer or a primer layer is formed. These layers may be formed in the same manner as those described in, for example, each specification of Japanese Patent Nos. 3,585,599 and 2,925,244.

(Support)

In the present invention, a waterproof support is preferably used as the support. The use of the waterproof support makes it possible to prevent the support from absorbing moisture, whereby a fluctuation in the performance of the receptor layer with lapse of time can be prevented. As the waterproof support, for example, coated paper or laminate paper may be used.

-Coated Paper-

The coated paper is paper obtained by coating a sheet such as base paper with various resins, rubber latexes, or high-molecular materials, on one side or both sides of the sheet, wherein the coating amount differs depending on its use. Examples of such coated paper include art paper, cast coated paper, and Yankee paper.

It is proper to use a thermoplastic resin as the resin to be applied to the surface(s) of the base paper. As such a thermoplastic resin, the following thermoplastic resins (A) to (H) may be exemplified.

(A) Polyolefin resins such as polyethylene resin and polypropylene resin; copolymer resins composed of an olefin such as ethylene or propylene and another vinyl monomer; and acrylic resin.

(B) Thermoplastic resins having an ester linkage: for example, polyester resins obtained by condensation of a dicarboxylic acid component (such a dicarboxylic acid component may be substituted with a sulfonic acid group, a carboxyl group, or the like) and an alcohol component (such an alcohol component may be substituted with a hydroxyl group, or the like); polyacrylate resins or polymethacrylate resins such as polymethylmethacrylate, polybutylmethacrylate, polymethylacrylate, polybutylacrylate, or the like; polycarbonate resins, polyvinyl acetate resins, styrene acrylate resins, styrene-methacrylate copolymer resins, vinyltoluene acrylate resins, or the like.

Concrete examples of them are those described in JP-A-59-101395, JP-A-63-7971, JP-A-63-7972, JP-A-63-7973, and JP-A-60-294862.

Commercially available thermoplastic resins usable herein are, for example, Vylon 290, Vylon 200, Vylon 280, Vylon 300, Vylon 103, Vylon GK-140, and Vylon GK-130 (products of Toyobo Co., Ltd.); Tafton NE-382, Tafton U-5, ATR-2009, and ATR-2010 (products of Kao Corporation); Elitel UE 3500, UE 3210, XA-8153, KZA-7049, and KZA-1449 (products of Unitika Ltd.); and Polyester TP-220 and R-188 (products of The Nippon Synthetic Chemical Industry Co., Ltd.); and thermoplastic resins in the Hyros series from Seiko Chemical Industries Co., Ltd., and the like (all of these names are trade names).

(C) Polyurethane resins, etc.

(D) Polyamide resins, urea resins, etc.

(E) Polysulfone resins, etc.

(F) Polyvinyl chloride resins, polyvinylidene chloride resins, vinyl chloride/vinyl acetate copolymer resins, vinyl chloride/vinyl propionate copolymer resins, etc.

(G) Polyol resins such as polyvinyl butyral; and cellulose resins such as ethyl cellulose resin and cellulose acetate resin, and (H) Polycaprolactone resins, styrene/maleic anhydride resins, polyacrylonitrile resins, polyether resins, epoxy resins, and phenolic resins.

The thermoplastic resins may be used either alone or in combination of two or more.

The thermoplastic resin may contain a whitener, a conductive agent, a filler, a pigment or dye including, for example, titanium oxide, ultramarine blue, and carbon black; or the like, if necessary.

-Laminated Paper-

The laminated paper is a paper which is formed by laminating various kinds of resin, rubber, polymer sheets or films on a sheet such as a base paper or the like. Specific examples of the materials useable for the lamination include polyolefins, polyvinyl chlorides, polyethylene terephthalates, polystyrenes, polymethacrylates, polycarbonates, polyimides, and triacetylcelluloses. These resins may be used alone, or in combination of two or more.

Generally, the polyolefins are prepared by using a low-density polyethylene. However, for improving the thermal resistance of the support, it is preferred to use a polypropylene, a blend of a polypropylene and a polyethylene, a high-density polyethylene, or a blend of a high-density polyethylene and a low-density polyethylene. From the viewpoint of cost and its suitableness for the laminate, it is preferred to use the blend of a high-density polyethylene and a low-density polyethylene.

The blend of a high-density polyethylene and a low-density polyethylene is preferably used in a blend ratio (a mass ratio) of 1/9 to 9/1, more preferably 2/8 to 8/2, and most preferably 3/7 to 7/3. When the thermoplastic resin layer is formed on the both surfaces of the support, the back side of the support is preferably formed using, for example, the high-density polyethylene or the blend of a high-density polyethylene and a low-density polyethylene. The molecular weight of the polyethylenes is not particularly limited. Preferably, the high-density polyethylene and the low-density polyethylene each have a melt index of 1.0 to 40 g/10 minute and a high extrudability.

The sheet or film may be subjected to a treatment to impart white reflection thereto. As a method of such a treatment, for example, a method of incorporating a pigment such as titanium oxide into the sheet or film can be mentioned.

The thickness of the support is preferably from 25 μm to 300 μm, more preferably from 50 μm to 260 μm, and further preferably from 75 μm to 220 μm. The support can have any rigidity according to the purpose. When it is used as a support for electrophotographic image-receiving sheet of photographic image quality, the rigidity thereof is preferably near to that in a support for use in color silver halide photography.

(Curling Control Layer)

When the support is exposed as it is, there is the case where the heat-sensitive transfer image-receiving sheet is made to curl by moisture and/or temperature in the environment. It is therefore preferable to form a curling control layer on the backside of the support. The curling control layer not only prevents the image-receiving sheet from curling but also has a water-proof function. For the curling control layer, a polyethylene laminate, a polypropylene laminate or the like is used. Specifically, the curling control layer may be formed in a manner similar to those described in, for example, JP-A-61-110135 and JP-A-6-202295.

(Writing Layer and Charge Controlling Layer)

For the writing layer and the charge control layer, an inorganic oxide colloid, an ionic polymer, or the like may be used. As the antistatic agent, any antistatic agents including cationic antistatic agents such as a quaternary ammonium salt and polyamine derivative, anionic antistatic agents such as alkyl phosphate, and nonionic antistatic agents such as fatty acid ester may be used. Specifically, the writing layer and the charge control layer may be formed in a manner similar to those described in the specification of Japanese Patent No. 3585585.

The method of producing the heat-sensitive transfer image-receiving sheet according to the present invention is explained below.

The heat-sensitive transfer image-receiving sheet according to the present invention may be prepared by coating each of layers using a usual method such as a roll coating, a bar coating, a gravure coating and a gravure reverse coating, followed by drying the layers.

Alternatively, the heat-sensitive transfer image-receiving sheet according to the present invention may be also prepared by simultaneous multi-layer coating the receptor layer and the heat insulation layer on the support.

It is known that in the case of producing an image-receiving sheet composed of plural layers having different functions from each other (for example, an air cell layer, heat insulation layer, intermediate layer, and receptor layer) on a support, it may be produced by applying and overlapping each layer one by one or by applying materials prepared in advance by coating a support with each layer, as shown in, for example, JP-A-2004-106283, JP-A-2004-181888, and JP-A-2004-345267. It has been known in photographic industries, on the other hand, that productivity can be greatly improved by applying plural layers simultaneously as a multilayer. For example, there are known methods such as the so-called slide coating (slide coating method) and curtain coating (curtain coating method) as described in, for example, U.S. Pat. Nos. 2,761,791, 2,681,234, 3,508,947, 4,457,256 and 3,993,019; JP-A-63-54975, JP-A-61-278848, JP-A-55-86557, JP-A-52-31727, JP-A-55-142565, JP-A-5043140, JP-A-63-80872, JP-A-54-54020, JP-A-5-104061, JP-A-5-127305, and JP-B-49-7050; and Edgar B. Gutoff, et al., "Coating and Drying Defects Troubleshooting Operating Problems", John Wiley & Sons Company, 1995, pp. 101-103.

In the present invention, it has been found that the productivity is greatly improved and image defects can be remarkably reduced at the same time, by using the above simultaneous multilayer coating for the production of an image-receiving sheet having a multilayer structure.

The plural layers in the present invention are structured using resins as their major components. Coating solutions for forming respective layers are preferably water-dispersible latexes. The solid content by mass of the resin put in a latex state in each layer coating solution is preferably in a range from 5 to 80% and particularly preferably 20 to 60%. The average particle size of the resin contained in the above water-dispersed latex is preferably 5 μm or less and particularly preferably 1 μm or less. The above water-dispersed latex may contain a known additive, such as a surfactant, a dispersant, and a binder resin, according to the need.

In the present invention, it is preferred that a laminate composed of plural layers be formed on a support and solidified just after the forming, according to the method described in U.S. Pat. No. 2,761,791. For example, in the case of solidifying a multilayer structure by using a resin, it is preferable to raise the temperature immediately after the plural layers are formed on the support. Also, in the case where a binder (e.g., a gelatin) that causes gelation at lower temperatures is contained, it is sometimes preferable to drop the temperature immediately after the plural layers are formed on the support.

In the present invention, the coating amount of a coating solution per one layer constituting the multilayer is preferably in a range from 1 g/m$^2$ to 500 g/m$^2$. The number of layers in the multilayer structure may be arbitrarily selected from a number of 2 or more. The receptor layer is preferably disposed as a layer most apart from the support.

In the method of forming an image through the use of the heat-sensitive transfer image-receiving sheet of the present invention, a heat-sensitive transfer sheet (ink sheet) used in combination with the heat-sensitive transfer image-receiving sheet according to the present invention as mentioned above at the time of formation of heat transfer image is preferably a sheet having on a support a dye layer containing a diffusion-transfer dye, and any ink sheet can be used as the sheet. As a means for providing heat energy in the thermal transfer, any of the conventionally known providing means may be used. For example, application of a heat energy of about 5 to 100 mJ/mm$^2$ by controlling recording time in a recording device such as a thermal printer (trade name: Video Printer VY-100, manufactured by Hitachi, Ltd.), sufficiently attains the expected result.

Also, the heat-sensitive transfer image-receiving sheet for use in the present invention may be used in various applications enabling thermal transfer recording, such as heat-sensitive transfer image-receiving sheets in a form of thin sheets (cut sheets) or rolls; cards; and transmittable type manuscript-making sheets, by optionally selecting the type of support.

The present invention may be utilized for printers, copying machines and the like, which employs a heat-sensitive transfer recording system.

According to the present invention, it is possible to provide a heat-sensitive transfer image-receiving sheet, which gives high transfer densities in high-speed transfer processing, which is reduced in image defects resulting from sticking due to welding with an ink, which is reduced in defects at the time of transmit through a printer, and which is free of uneven transfer of a protective layer, and which gives a high quality image; and further to provide a method of forming an image through the use of such an image-receiving sheet.

The present invention will be described in more detail based on the following examples, but the invention is not intended to be limited thereto.

EXAMPLES

In the following Examples, the terms "part" and "%" are values by mass, unless they are indicated differently in particular.

Reference Example (Preparation of Ink Sheet)

A polyester film 6.0 μm in thickness (trade name: Lumirror, manufactured by Toray Industries, Inc.) was used as the substrate film. A heat-resistant slip layer (thickness: 1 μm) was formed on the back side of the film, and the following yellow, magenta, and cyan compositions, and the protective layer composition were respectively applied as a monochromatic layer (coating amount: 1 g/m$^2$ after drying) on the front side.

| Yellow composition | |
|---|---|
| Dye (trade name: Macrolex Yellow 6G, manufactured by Byer) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |

-continued

| Magenta composition | |
|---|---|
| Magenta dye (Disperse Red 60) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |
| **Cyan composition** | |
| Cyan dye (Solvent Blue 63) | 5.5 parts by mass |
| Polyvinylbutyral resin (trade name: ESLEC BX-1, manufactured by Sekisui Chemical Co., Ltd.) | 4.5 parts by mass |
| Methyl ethyl ketone/toluene (1/1, at mass ratio) | 90 parts by mass |
| **Composition of protective layer** | |
| Polyvinyl acetal resin (trade name: KS-10, manufactured by Sekisui Chemical Co., Ltd.) | 5.5 parts by mass |
| Colloidal silica (trade name: IPA-ST, manufactured by Nissan Chemical Industries, Ltd.) | 4 parts by mass |
| Diethyl ketone/isopropyl alcohol (8/2, at mass ratio) | 90 parts by mass |

Example 1

(Preparation of Image-Receiving Sheets)

(1-1) Preparation of Sample 101 (This Invention)

A synthetic paper (thickness: 200 μm; Yupo FPG 200 (trade name), manufactured by Yupo Corporation) was used as a support, and one side of this paper was coated with a receptor layer having the following composition. The coating was performed so that the receptor layer had a coating amount of 4.0 g/m$^2$, and the layer coated was dried at 50° C.

| Composition of receptor layer | |
|---|---|
| Vinyl chloride latex (Tg: 73° C.; VINYBLAN 900 (trade name), manufactured by Nissin Chemical Industry Co., Ltd.) | 350 parts by mass |
| SBR latex (Tg: 27° C., LX410, trade name, manufactured by Zeon Corporation) | 150 parts by mass |
| Montan acid wax (J537, trade name, manufactured by Chukyo Yushi Co., Ltd.) | 35 parts by mass |

(1-2) Preparation of Sample 102 (this invention)

Sample 102 was prepared in the same manner as Sample 101, except that the composition of the receptor layer was changed to the following composition.

| Composition of receptor layer | |
|---|---|
| Vinyl chloride latex (Tg: 73° C.; VINYBLAN 900 (trade name), manufactured by Nissin Chemical Industry Co., Ltd.) | 350 parts by mass |
| Gelatin | 25 parts by mass |
| SBR latex (Tg: 27° C., LX410, trade name, manufactured by Zeon Corporation) | 150 parts by mass |
| Montan acid wax (1537, trade name, manufactured by Chukyo Yushi Co., Ltd.) | 35 parts by mass |
| Compound X (crosslinking agent) | 2 parts by mass |

Compound X

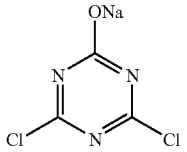

(1-3) Preparation of Samples 103 to 115 and 202 to 206

Samples 103 to 115 were prepared in the same manner as Sample 102, except that the latex polymer, the gelatin and the wax used in Sample 102 were changed to those shown in Table 1, respectively.

In addition, Samples 202 to 206 were prepared in the same manner as Samples 102 to 106, respectively, except that diglycidyl ethyl ether was further added in a proportion of 2 mass % to the gelatin.

(Image Formation and Evaluation)

The ink sheet prepared in the reference example and the image-receiving sheets of Samples 101 to 115 and Samples 201 to 206 were each worked to be made loadable in a sublimation printer, DPB 1500 (trade name, manufactured by Nidec Copal Corporation), and image outputs were produced on those image-receiving sheets in settings that permit production of all the gradations (shades) of gray from the minimum density to the maximum density in a high-speed printing mode. Herein, output of one L-size print took 13 seconds.

For evaluation of transferring property of dyes, densities of images obtained by transfer of dyes were measured.

For evaluation of releasing property of the image-receiving sheet from ink sheet, a solid image at the maximum density was outputted, on each image-receiving sheet in accordance with the foregoing method, and the surface of the obtained outputs were observed to evaluate the extent of streaked unevenness (sticking) on the surface thereof. At the same time, noises caused by this processing were caught and their volume was evaluated.

As to the transferring property of protective layer, an observation was made on transfer unevenness of protective layer to the image surface of the output wherein the gray gradations were produced.

These evaluation results were ranked as shown below, and the results are shown in Table 2.

Evaluation Rank

◎: Better results than the level for ○ were obtained.

○: Good results were obtained without any problems.

Δ: Results obtained showed tendencies to deteriorate; still, they were on an acceptable level.

X: Results obtained had problems, so they were on an unacceptable level.

It is apparent from the results shown in Table 2, Samples according to the present invention 101 to 105, 107, 108, 113 to 115 and 202 to 205 were satisfactory for all the criteria of transferring property of dyes, releasing property of image-receiving sheet from ink sheet, and transferring property of protective layer, as compared with the comparative samples. Therefore, the present invention can provide the image-receiving sheet satisfying in all the above criteria.

TABLE 1

| Sample No. | Latex polymer having Tg of more than 50° C. | Latex polymer having Tg of 50° C. or less | Wax | Water-soluble polymer | Crosslinking agent | Remarks |
|---|---|---|---|---|---|---|
| 101 | VINYBLAN 900 Vinyl chloride latex, (Tg: 73° C.; manufactured by Nissin Chemical Industry Co., Ltd.) | LX410, SBR latex (Tg: 27° C.; manufactured by Zeon Corporation) | J537, Montan wax (manufactured by Chukyo Yushi Co., Ltd.) | — | — | This invention |
| 102 | VINYBLAN 900 Vinyl chloride latex, (Tg: 73° C.; manufactured by Nissin Chemical Industry Co., Ltd.) | LX410, SBR latex (Tg: 27° C.; manufactured by Zeon Corporation) | J537, Montan wax (manufactured by Chukyo Yushi Co., Ltd.) | Gelatin | Compound X | This invention |
| 103 | VINYBLAN 900 Vinyl chloride latex, (Tg: 73° C.; manufactured by Nissin Chemical Industry Co., Ltd.) | LX814, Acrylate-series latex (Tg: 25° C.; manufactured by Zeon Corporation) | J537, Montan wax (manufactured by Chukyo Yushi Co., Ltd.) | " | " | This invention |
| 104 | VINYBLAN 900 Vinyl chloride latex, (Tg: 73° C.; manufactured by Nissin Chemical Industry Co., Ltd.) | LX857X2, Acrylate-series latex (Tg: 43° C.; manufactured by Zeon Corporation) | J537, Montan wax (manufactured by Chukyo Yushi Co., Ltd.) | " | " | This invention |
| 105 | VINYBLAN 900 Vinyl chloride latex, (Tg: 73° C.; manufactured by Nissin Chemical Industry Co., Ltd.) | LX416, SBR latex (Tg: 50° C.; manufactured by Zeon Corporation) | J537, Montan wax (manufactured by Chukyo Yushi Co., Ltd.) | " | " | This invention |
| 106 | VINYBLAN 900 Vinyl chloride latex, (Tg: 73° C.; manufactured by Nissin Chemical Industry Co., Ltd.) | 2507H, SBR-series latex (Tg: 58° C.; manufactured by Zeon Corporation) | J537, Montan wax (manufactured by Chukyo Yushi Co., Ltd.) | " | " | Comparative example |
| 107 | VINYBLAN 900 Vinyl chloride latex, (Tg: 73° C.; manufactured by Nissin Chemical Industry Co., Ltd.) | VINYBLAN 276 Vinyl chloride latex, (Tg: 33° C.; manufactured by Nissin Chemical Industry Co., Ltd.) | J537, Montan wax (manufactured by Chukyo Yushi Co., Ltd.) | " | " | This invention |
| 108 | VINYBLAN 900 Vinyl chloride latex, (Tg: 73° C.; manufactured by Nissin Chemical Industry Co., Ltd.) | VINYBLAN 609 Vinyl chloride latex, (Tg: 48° C.; manufactured by Nissin Chemical Industry Co., Ltd.) | J537, Montan wax (manufactured by Chukyo Yushi Co., Ltd.) | PVA105 Polyvinyl alcohol | " | This invention |
| 109 | VINYBLAN 900 Vinyl chloride latex, (Tg: 73° C.; manufactured by Nissin Chemical Industry Co., Ltd.) | — | J537, Montan wax (manufactured by Chukyo Yushi Co., Ltd.) | Gelatin | " | Comparative example |
| 110 | VINYBLAN 900 Vinyl chloride latex, (Tg: 73° C.; manufactured by Nissin Chemical Industry Co., Ltd.) | VINYBLAN 276 Vinyl chloride latex, (Tg: 33° C.; manufactured by Nissin Chemical Industry Co., Ltd.) | — | " | " | Comparative example |
| 111 | — | VINYBLAN 276 Vinyl chloride latex, (Tg: 33° C.; manufactured by Nissin Chemical Industry Co., Ltd.) | J537, Montan wax (manufactured by Chukyo Yushi Co., Ltd.) | Gelatin | Compound X | Comparative example |
| 112 | — | VINYBLAN 609 Vinyl chloride latex, (Tg: 48° C.; manufactured by Nissin Chemical Industry Co., Ltd.) | J537, Montan wax (manufactured by Chukyo Yushi Co., Ltd.) | " | " | Comparative example |
| 113 | VINYBLAN 900 Vinyl chloride latex, (Tg: 73° C.; | VINYBLAN 609 Vinyl chloride latex, (Tg: 48° C.; manufactured by Nissin | Cellozole 524, Carnauba wax, (manufactured by Chukyo | " | " | This invention |

TABLE 1-continued

| Sample No. | Latex polymer having Tg of more than 50° C. | Latex polymer having Tg of 50° C. or less | Wax | Water-soluble polymer | Crosslinking agent | Remarks |
|---|---|---|---|---|---|---|
| | manufactured by Nissin Chemical Industry Co., Ltd.) | Chemical Industry Co., Ltd.) | Yushi Co., Ltd.) | | | |
| 114 | VINYBLAN 900 Vinyl chloride latex, (Tg: 73° C.; manufactured by Nissin Chemical Industry Co., Ltd.) | VINYBLAN 609 Vinyl chloride latex, (Tg: 48° C.; manufactured by Nissin Chemical Industry Co., Ltd.) | NEW AID NW-A, PE wax (manufactured by Seiko Chemical Co., Ltd.) | " | " | This invention |
| 115 | VINYBLAN 900 Vinyl chloride latex, (Tg: 73° C.; manufactured by Nissin Chemical Industry Co., Ltd.) | VINYBLAN 609 Vinyl chloride latex, (Tg: 48° C.; manufactured by Nissin Chemical Industry Co., Ltd.) | EMUSTER-042X Microcrystalline wax (manufactured by Nippon Seiro Co., Ltd) | " | " | This invention |
| 202 | VINYBLAN 900 Vinyl chloride latex, (Tg: 73° C.; manufactured by Nissin Chemical Industry Co., Ltd.) | LX410, SBR latex (Tg: 27° C.; manufactured by Zeon Corporation) | J537, Montan wax (manufactured by Chukyo Yushi Co., Ltd.) | " | Diglycidyl ethyl ether | This invention |
| 203 | VINYBLAN 900 Vinyl chloride latex, (Tg: 73° C.; manufactured by Nissin Chemical Industry Co., Ltd.) | LX814, Acrylate-series latex (Tg: 25° C.; manufactured by Zeon Corporation) | J537, Montan wax (manufactured by Chukyo Yushi Co., Ltd.) | " | Diglycidyl ethyl ether | This invention |
| 204 | VINYBLAN 900 Vinyl chloride latex, (Tg: 73° C.; manufactured by Nissin Chemical Industry Co., Ltd.) | LX857X2, Acrylate-series latex (Tg: 43° C.; manufactured by Zeon Corporation) | J537, Montan wax (manufactured by Chukyo Yushi Co., Ltd.) | " | Diglycidyl ethyl ether | This invention |
| 205 | VINYBLAN 900 Vinyl chloride latex, (Tg: 73° C.; manufactured by Nissin Chemical Industry Co., Ltd.) | LX416, SBR latex (Tg: 50° C.; manufactured by Zeon Corporation) | J537, Montan wax (manufactured by Chukyo Yushi Co., Ltd.) | " | Diglycidyl ethyl ether | This invention |
| 206 | VINYBLAN 900 Vinyl chloride latex, (Tg: 73° C.; manufactured by Nissin Chemical Industry Co., Ltd.) | 2507H, SBR-series latex (Tg: 58° C.; manufactured by Zeon Corporation) | J537, Montan wax (manufactured by Chukyo Yushi Co., Ltd.) | " | Diglycidyl ethyl ether | Comparative example |

"—" means not added.

TABLE 2

| Sample No | Remarks | Transfer density | Sticking | Noise when peeling off ink sheet | Protective-layer-transfer unevenness |
|---|---|---|---|---|---|
| 101 | This invention | ○ | Δ | ○ | ○ |
| 102 | This invention | ○ | ○ | ○ | ○ |
| 103 | This invention | ○ | ○ | ○ | ○ |
| 104 | This invention | ○ | ○ | ○ | Δ |
| 105 | This invention | ○ | ○ | ○ | Δ |
| 106 | Comparative example | ○ | ○ | ○ | X |
| 107 | This invention | ◎ | ○ | ○ | ○ |
| 108 | This invention | ○ | ○ | ○ | Δ |
| 109 | Comparative example | ○ | ○ | ○ | X |
| 110 | Comparative example | ◎ | X | X | ◎ |
| 111 | Comparative example | ◎ | X | ○ | ○ |
| 112 | Comparative example | ○ | X | Δ | Δ |
| 113 | This invention | ◎ | ○ | ○ | ○ |
| 114 | This invention | ○ | Δ | Δ | ○ |
| 115 | This invention | ○ | ○ | ○ | ○ |
| 202 | This invention | ○ | ○ | Δ | ○ |
| 203 | This invention | ○ | ○ | ○ | ○ |

TABLE 2-continued

| Sample No | Remarks | Transfer density | Sticking | Noise when peeling off ink sheet | Protective-layer-transfer unevenness |
|---|---|---|---|---|---|
| 204 | This invention | Δ | ◎ | ◎ | ○ |
| 205 | This invention | Δ | ○ | ◎ | Δ |
| 206 | Comparative example | Δ | ○ | ○ | X |

Example 2

1. Preparation of Image-Receiving Sheet (Preparation of Support)

A pulp slurry was prepared from 50 parts by mass of hardwood kraft pulp (LBKP) of acacia origin and 50 parts by mass of hardwood kraft pulp (LBKP) of aspen origin, by beating these pulps by means of a disk refiner until Canadian standard freeness reached to 300 ml.

To the pulp slurry thus prepared were added, on a pulp basis, 1.3 mass % of modified cationic starch (CAT0304L, trade name, manufactured by Nippon NSC), 0.15 mass % of anionic polyacrylamide (DA4104, trade name, manufactured by Seiko PMC Corporation), 0.29 mass % of an alkylketene dimer (SIZEPINE K, trade name, manufactured by Arakawa Chemical Industries, Ltd.), 0.29 mass % of epoxidated behenic acid amide, and 0.32 mass % of polyamide polyamine epichlorohydrin (ARAFIX 100, trade name, manufactured by Arakawa Chemical Industries, Ltd.), and thereafter 0.12 mass % of a defoaming agent was further added.

The resulting pulp slurry was made into paper by use of a fourdrinier paper machine. In a process of drying in which the felt side of web was pressed against a drum dryer cylinder via a dryer canvas, the web thus formed was dried under a condition that the tensile strength of the dryer canvas was adjusted to 1.6 kg/cm. Then, each side of the raw paper thus made was coated with 1 g/m$^2$ of polyvinyl alcohol (KL-118, trade name, manufactured by Kuraray Co., Ltd.) with a size press, then, dried and further subjected to calendering treatment. Therein, the papermaking was performed so that the raw paper had a grammage (basis weight) of 157 g/m$^2$, and the raw paper (base paper) having a thickness of 160 μm was obtained.

The wire side (back side) of the base paper obtained was subjected to corona discharge treatment, and thereto a resin composition, in which a high-density polyethylene having an MFR (which stands for a melt flow rate, and hereinafter has the same meaning) of 16.0 g/10 min and a density of 0.96 g/cm$^3$ (containing 250 ppm of hydrotalcite (DHT-4A (trade name), manufactured by Kyowa Chemical Industry Co., Ltd.) and 200 ppm of a secondary oxidation inhibitor (tris(2,4-di-t-butylphenyl)phosphite, Irugaphos 168 (trade name), manufactured by Ciba Specialty Chemicals)) and a low-density polyethylene having an MFR of 4.0 g/10 min and a density of 0.93 g/cm$^3$ were mixed at a ratio of 75 to 25 by mass, was applied so as to have a thickness of 21 g/m$^2$, by means of a melt extruder, thereby forming a thermoplastic resin layer with a mat surface. (The side to which this thermoplastic resin layer was provided is hereinafter referred to as "back side"). The thermoplastic resin layer at the back side was further subjected to corona discharge treatment, and then coated with a dispersion prepared by dispersing into water a 1:2 mixture (by mass) of aluminum oxide (ALUMINASOL 100, trade name, manufactured by Nissan Chemical Industries, Ltd.) and silicon dioxide (SNOWTEX O, trade name, manufactured by Nissan Chemical Industries, Ltd.), as an antistatic agent, so that the coating had a dry mass of 0.2 g/m$^2$. Subsequently, the front surface (front side) of the base paper was subjected to corona discharge treatment, and then coated with 27 g/m$^2$ of a low-density polyethylene having an MFR of 4.0 g/10 min and a density of 0.93 g/m$^3$ and containing 10 mass % of titanium oxide, by means of a melt extruder, thereby forming a thermoplastic resin layer with a specular surface.

(Preparation of Emulsion)

An emulsified dispersion A was prepared in the following manner. A compound A-6, which will be shown later, was dissolved in a mixture of 42 g of a high-boiling solvent (Solv-1) and 20 ml of ethyl acetate, and the resulting solution was emulsified and dispersed in 250 g of a 20 mass % aqueous gelatin solution containing 1 g of sodium dodecylbenzenesulfonate by means of a high-speed stirring emulsification machine (dissolver). Thereto, water was added to prepare 380 g of an emulsified dispersion A.

Therein, the addition amount of compound A-6 was adjusted so that the compound would be contained in an amount of 30 mole % in the emulsified dispersion A.

Solv-1

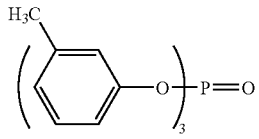

A-6

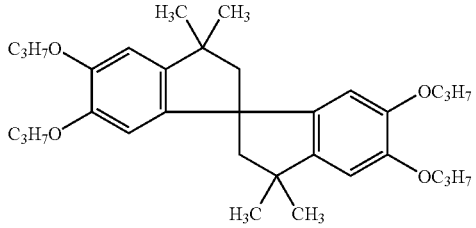

(Preparation of Image-Receiving Sheets)

On the support prepared in the foregoing manner was formed a multilayer coat consisting of a subbing layer 1, a subbing layer 2, a heat insulation layer, and a receptor layer, which were stacked on top of each other in the order described, by simultaneous double-layer coating. The compositions and coating amounts of coating solutions used therein are shown below.

| Coating solution for subbing layer 1 (Composition) | |
|---|---|
| Aqueous solution prepared by adding 1% sodium dodecylbenzenesulfonate to 3% aqueous gelatin solution | |
| NaOH for adjusting pH to 8 | |
| (Coating amount) | 11 ml/m$^2$ |
| **Coating solution for subbing layer 2 (Composition)** | |
| Styrene-butadiene latex (SR103 (trade name), manufactured by Nippon A & L Inc.) | 60 parts by mass |
| 6% Aqueous solution of polyvinyl alcohol (PVA) | 40 parts by mass |
| NaOH for adjusting pH to 8 | |
| (Coating amount) | 11 ml/m$^2$ |
| **Coating solution for heat insulation layer (Composition)** | |
| Hollow latex polymer (MH5055 (trade name), manufactured by Zeon Corporation) | 60 parts by mass |
| 10% Gelatin aqueous solution | 20 parts by mass |
| Emulsified dispersion A prepared in the above | 20 parts by mass |
| NaOH for adjusting pH to 8 | |
| (Coating amount) | 45 ml/m$^2$ |
| **Coating solution for receptor layer (Composition)** | |
| The same receptor layer coating solution as used in Example 1 was used. The sample thus obtained the same results as the samples in Example 1, which indicates that the same effects can be achieved even by the use of hollow polymers for a heat insulation layer. | |

Having described our invention as related to the present embodiments, it is our intention that the invention not be limited by any of the details of the description, unless otherwise specified, but rather be construed broadly within its spirit and scope as set out in the accompanying claims.

What we claim is:

1. A heat-sensitive transfer image-receiving sheet, comprising at least one receptor layer containing a latex polymer of a vinyl chloride acrylate copolymer which has a glass transition temperature of 50° C. or less, a latex polymer of a homopolymer of vinyl chloride or a latex polymer of a copolymer of vinyl chloride and alkyl acrylate which has a glass transition temperature of 73° C. to 120° C., and a wax dispersion, wherein at least one of the latex polymers is present in a particulate state without forming film.

2. The heat-sensitive transfer image-receiving sheet as claimed in claim 1, which further contains a water-soluble polymer in addition to the latex polymer.

3. The heat-sensitive transfer image-receiving sheet as claimed in claim 2, which further contains a compound capable of cross-linking molecules of the water-soluble polymer and thereby at least a part of the water-soluble polymer molecules are cross-linked.

4. The heat-sensitive transfer image-receiving sheet as claimed in claim 1, which further has at least one heat insulation layer, wherein the heat insulation layer has a void structure or contains hollow polymer particles.

5. The heat-sensitive transfer image-receiving sheet as claimed in claim 4, wherein the heat insulation layer contains hollow polymer particles.

6. A method of forming an image, which uses the heat-sensitive transfer image-receiving sheet as claimed in claim 1 and a heat-sensitive transfer sheet having a dye on a support, wherein the method comprises the steps of bringing these sheets into face-to-face contact with each other and applying heat thereto, to form a heat-transferred dye image.

7. The heat-sensitive transfer image-receiving sheet as claimed in claim 1, wherein the latex polymer having a glass transition temperature of 73° C. to 120° C. is the latex polymer of a copolymer of vinyl chloride and alkyl acrylate.

8. The heat-sensitive transfer image-receiving sheet as claimed in claim 1, wherein the receptor layer contains a gelatin.

9. The heat-sensitive transfer image-receiving sheet as claimed in claim 1, wherein the heat-sensitive transfer image-receiving sheet comprises a heat insulation layer between the support and the receptor layer, and the heat insulation layer contains non-foaming type hollow polymer particles which are formed of a polystyrene, acryl resin, or styrene/acryl resin and which have a particle size of 0.1 to 2 μm.

10. The heat-sensitive transfer image-receiving sheet as claimed in claim 1, wherein the heat-sensitive transfer image-receiving sheet comprises a heat insulation layer between the support and the receptor layer, and the heat insulation layer contains a water-soluble polymer and non-foaming type hollow polymer particles which are formed of a polystyrene, acryl resin, or styrene/acryl resin and which have a particle size of 0.1 to 2 μm.

11. The heat-sensitive transfer image-receiving sheet as claimed in claim 1, wherein the heat-sensitive transfer image-receiving sheet comprises a heat insulation layer between the support and the receptor layer, and the heat insulation layer contains a gelatin and non-foaming type hollow polymer particles which are formed of a polystyrene, acryl resin, or styrene/acryl resin and which have a particle size of 0.1 to 2 μm.

12. The heat-sensitive transfer image-receiving sheet as claimed in claim 1, wherein the receptor layer contains an emulsified dispersion containing an agent for imparting fastness to images or an ultraviolet absorbent.

13. The heat-sensitive transfer image-receiving sheet as claimed in claim 1, wherein the heat-sensitive transfer image-receiving sheet comprises a heat insulation layer between the support and the receptor layer, and the heat insulation layer contains a gelatin and non-foaming type hollow polymer particles which are formed of a polystyrene, acryl resin, or styrene/acryl resin and which have a particle size of 0.1 to 2 μm and further the heat insulation layer contains an emulsified dispersion containing an agent for imparting fastness to images or an ultraviolet absorbent.

* * * * *